US008191491B2

(12) United States Patent
Hirose

(10) Patent No.: US 8,191,491 B2
(45) Date of Patent: Jun. 5, 2012

(54) SEWING MACHINE AND COMPUTER-READABLE MEDIUM STORING CONTROL PROGRAM EXECUTABLE ON SEWING MACHINE

(75) Inventor: Hirokazu Hirose, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 139 days.

(21) Appl. No.: 12/659,744

(22) Filed: Mar. 19, 2010

(65) Prior Publication Data

US 2010/0242818 A1 Sep. 30, 2010

(30) Foreign Application Priority Data

Mar. 31, 2009 (JP) ..... 2009-083838

(51) Int. Cl.
*D05B 21/00* (2006.01)

(52) U.S. Cl. ..... 112/102.5

(58) Field of Classification Search ..... 112/102.5, 112/272, 470.02, 470.03, 470.04, 470.05, 112/475.18, 475.19; 700/136, 137, 138
See application file for complete search history.

(56) References Cited

U.S. PATENT DOCUMENTS

| | | | | |
|---|---|---|---|---|
| 4,841,890 | A | 6/1989 | Tancs | |
| 5,027,730 | A | 7/1991 | Dobnet et al. | |
| 5,074,229 | A * | 12/1991 | Sasako et al. | 112/102.5 |
| 5,228,402 | A | 7/1993 | Sugimoto | |
| 5,947,043 | A * | 9/1999 | Morita et al. | 112/102.5 |
| 6,123,037 | A * | 9/2000 | Shimizu | 112/102.5 |
| 6,729,253 | B2 * | 5/2004 | Mamiya et al. | 112/470.05 |
| 2003/0140831 | A1 | 7/2003 | Zesch et al. | |

FOREIGN PATENT DOCUMENTS

| | | |
|---|---|---|
| DE | 37 07 321 C1 | 6/1988 |
| JP | A-5-64694 | 3/1993 |
| JP | A-5-137864 | 6/1993 |
| JP | A-6-101156 | 4/1994 |
| JP | A-07-018555 | 1/1995 |
| JP | A-8-71287 | 3/1996 |
| JP | A-08-218265 | 8/1996 |

(Continued)

OTHER PUBLICATIONS

Japanese Office Action issued in Application No. 2009-083838; Dated Mar. 15, 2011 (With Translation).

(Continued)

*Primary Examiner* — Tejash Patel
(74) *Attorney, Agent, or Firm* — Oliff & Berridge, PLC

(57) ABSTRACT

A sewing machine that is capable of sewing an embroidery pattern on a work cloth held by an embroidery frame includes a display device that is capable of displaying at least one of an image and embroidery information, a detection device that detects an occurrence of a thread break, an image capture device that is capable of capturing an image of at least an area including a needle drop point, a display control device that displays an image captured by the image capture device and an operation key on the display device in a case where the detection device has detected the occurrence of the thread break, the operation key being to be used to transfer the embroidery frame by at least one stitch, and a sewing control device that causes the embroidery frame to be transferred based on a number of stitches specified by operation of the operation key.

6 Claims, 15 Drawing Sheets

FOREIGN PATENT DOCUMENTS

| | | |
|---|---|---|
| JP | A-08-224389 | 9/1996 |
| JP | A-2000-386 | 1/2000 |

OTHER PUBLICATIONS

European Search Report issued in Application No. 10156935.8; Dated Jul. 15, 2011.

Japanese Office Action issued in Application No. 2008-003702; Dated Mar. 15, 2011 (With Translation).

Nov. 29, 2011 Decision on Rejection issued in Japanese Patent Application No. 2009- 083838 (with translation).

* cited by examiner

FIG. 12

111

| COUNTER VALUE N | COORDINATE DATA $(X_N, Y_N)$ |
|---|---|
| 0 | $(X_0, Y_0)$ |
| 1 | $(X_1, Y_1)$ |
| 2 | $(X_2, Y_2)$ |
| 3 | $(X_3, Y_3)$ |
| ⋮ | ⋮ |
| 1500 | $(X_{1500}, Y_{1500})$ |

SEWING MACHINE AND COMPUTER-READABLE MEDIUM STORING CONTROL PROGRAM EXECUTABLE ON SEWING MACHINE

CROSS-REFERENCE TO RELATED APPLICATION

This application claims priority to Japanese Patent Application No. 2009-083838, filed Mar. 31, 2009, the content of which is hereby incorporated herein by reference in its entirety.

BACKGROUND

The present disclosure relates to a sewing machine. More specifically, the present disclosure relates to a sewing machine and a computer-readable medium that stores a control program executable on a sewing machine that can capture an image of an area that includes a needle drop point in a case where a thread break occurs.

A sewing machine is known that is capable of performing embroidery sewing and is provided with an image capture device that captures an image of an area that includes a needle drop point of a needle. The sewing machine is provided with a display. It is possible to switch the display between displaying an image of the area that includes the needle drop point that was captured by the image capture device and displaying an ordinary screen. The switching of the screen that is displayed is performed by operating an image capture start button. In a case where the image capture start button is pressed while the ordinary screen is being displayed, the image capture device captures the image of the area that includes the needle drop point. The captured image is then displayed on the display with an indication of the needle drop point superimposed on the captured image. This makes it possible for a user to check the needle drop point and the state of the sewing without putting the user's face close to the needle drop point. In a case where the image capture start button is pressed in a state in which the captured image is being displayed, the ordinary screen is displayed once again.

A multi-head embroidery sewing machine is known that automatically stops driving of a sewing machine head in a case where a thread break occurs. In the multi-head embroidery sewing machine, when a thread break is detected by a thread break sensor, driving of the sewing machine head is stopped by a control device.

A sewing machine is known that is capable of performing embroidery sewing and in which an operation key is displayed for transferring an embroidery frame one of forward and back by a distance that corresponds to at least one stitch. In the sewing machine, in a case where the embroidery sewing is interrupted because trouble such as a thread break or the like is detected, if a help key is operated, stitch number input keys indicating "one stitch," "ten stitches," and "one hundred stitches" are displayed, along with indications of "forward" and "back," on a display with a touch panel. By operating the stitch number input keys, a user may move the needle drop point one of forward and back by the desired number of stitches. This makes it possible to restart sewing from the desired position in the embroidery pattern.

SUMMARY

In the known sewing machines that are described above, in a case where a thread break occurs, the sewing proceeds until driving of the sewing machine head is stopped. In other words, the work cloth is transferred, and the needle drop point is moved forward without any stitches being formed on the work cloth. Therefore, when resetting the thread and restarting the sewing, the user needs to return the needle drop point to the position where the thread break occurred.

In the known sewing machines, when returning the needle drop point to the position where the thread break occurred, the user may perform the operation of returning the needle drop point to the thread break position by operating the operation keys that are displayed on the display while visually checking the area that includes the needle drop point. In other words, it is necessary for the user to alternate any number of times between looking at the display and looking at the area that includes the needle drop point. Therefore, after a thread break has occurred, for the user may not smoothly perform the work of adjusting the needle drop point.

Various exemplary embodiments of the broad principles derived herein provide a sewing machine and a computer-readable medium that stores a control program executable on a sewing machine that allow a user to smoothly adjust a needle drop point in a case where a thread break occurs during embroidery sewing.

Exemplary embodiments provide a sewing machine that is capable of sewing an embroidery pattern on a work cloth held by an embroidery frame. The sewing machine includes a display device that is capable of displaying at least one of an image and embroidery information, a detection device that detects an occurrence of a thread break while sewing is in progress, and an image capture device that is capable of capturing an image of at least an area including a needle drop point of a needle. The sewing machine further includes a display control device that displays an image captured by the image capture device and an operation key on the display device in a case where the detection device has detected the occurrence of the thread break, the operation key being to be used to transfer the embroidery frame by at least one stitch, and a sewing control device that causes the embroidery frame to be transferred based on a number of stitches specified by operation of the operation key.

Exemplary embodiments also provide a computer-readable medium storing a control program executable on a sewing machine that is capable of sewing an embroidery pattern on a work cloth held by an embroidery frame. The program includes instructions that cause a computer to perform the steps of receiving a signal that is transmitted in a case where a thread break has occurred while sewing is in progress, displaying an image and an operation key on a display device in a case where the signal is received, the image being captured by an image capture device that is capable of capturing an image of at least an area including a needle drop point of a needle, the operation key being to be used to transfer the embroidery frame by at least one stitch, and the display device being capable of displaying at least one of the image and embroidery information, and causing the embroidery frame to be transferred based on a number of stitches specified by operation of the operation key.

BRIEF DESCRIPTION OF THE DRAWINGS

Exemplary embodiments will be described below in detail with reference to the accompanying drawings in which:

FIG. 12 is a data table that shows a sample embroidery pattern data set for sewing the sample embroidery pattern that is shown in FIG. 11;

DETAILED DESCRIPTION

Figure 1:
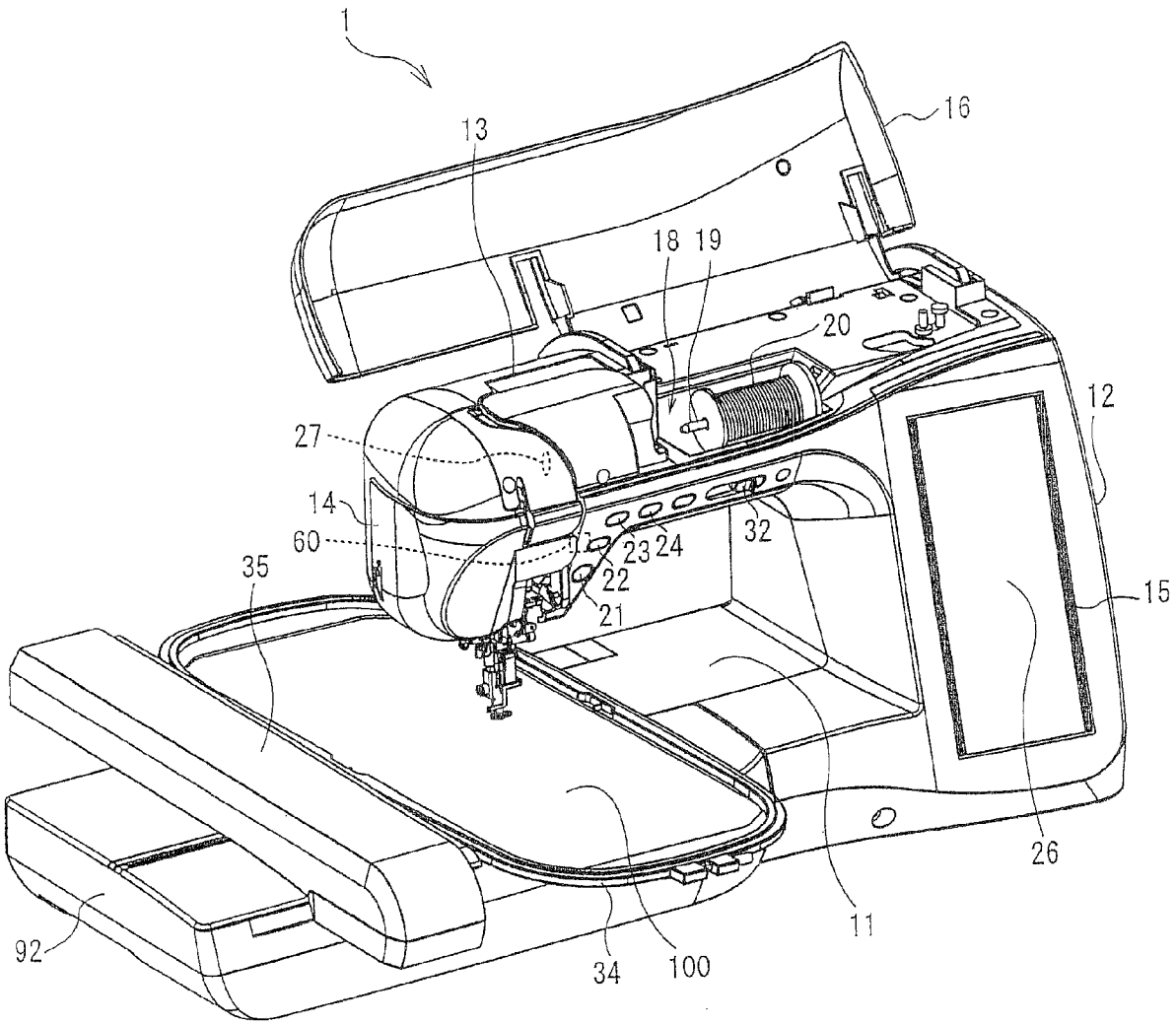
FIG. 1 is an oblique view of a sewing machine that is provided with an embroidery frame.

Hereinafter, an embodiment will be explained with reference to the drawings. First, a configuration of a sewing machine 1 will be explained with reference to FIGS. 1 and 2. In FIG. 1, the side of the sewing machine 1 that faces toward a user is referred to as the "front side," and the opposite side is referred to as the "rear side." The right-left direction of the sewing machine 1 as viewed from the user is referred to as the "right-left direction." The up-down direction of the sewing machine 1 as viewed as the user is referred to as the "up-down direction."

As shown in FIG. 1, the sewing machine 1 is provided with a bed 11, a pillar 12, an arm 13, and a head 14. The bed 11 extends in the right-left direction. The pillar 12 extends upward from the right end of the bed 11. The arm 13 extends to the left from the upper end of the pillar 12. The head 14 is provided in the left end portion of the arm 13. A needle plate (not shown in the drawings) is provided on the top face of the bed 11. A feed dog, a cloth feed mechanism, a feed adjustment pulse motor, and a shuttle mechanism, which are not shown in the drawings, are provided within the bed 11 underneath the needle plate. The feed dog feeds a work cloth to be sewn by a specified feed distance. The cloth feed mechanism drives the feed dog. The feed adjustment pulse motor 78 adjusts the feed distance.

An embroidery frame 34 that holds a work cloth 100 is disposed on the bed 11. The area within the embroidery frame 34 is an embroidery area in which a stitch of an embroidery pattern may be formed. An embroidery frame transfer unit 92 that transfers the embroidery frame 34 may be attached to and detached from the bed 11. A carriage cover 35 that extends in the front-rear direction is provided on the embroidery frame transfer unit 92. The carriage cover 35 contains a Y-axis transfer mechanism (not shown in the drawings). The Y-axis transfer mechanism transfers a carriage (not shown in the drawings) in a Y direction (the front-rear direction). The embroidery frame 34 may be attached to and detached from the carriage. A frame attachment portion (not shown in the drawings) on which the embroidery frame 34 is attached is provided on the right side of the carriage. The frame attachment portion projects outward to the right from the right side face of the carriage cover 35. An attaching portion (not shown in the drawings) that is provided on the left side of the embroidery frame 34 may be attached to the frame attachment portion. The carriage, the Y-axis transfer mechanism, and the carriage cover 35 are transferred in the X direction (the right-left direction) by an X-axis transfer mechanism (not shown in the drawings). The X-axis transfer mechanism is provided within the main body of the embroidery frame transfer unit 92. Thus the embroidery frame 34 is transferred in the X direction. The X-axis transfer mechanism and the Y-axis transfer mechanism are respectively driven by an X-axis motor 86 (refer to FIG. 6) and a Y-axis motor 87 (refer to FIG. 6). A needle bar 6 (refer to FIG. 2) and the shuttle mechanism (not shown in the drawings) are driven while the embroidery frame 34 is transferred in the X direction and the Y direction. In this manner, a pattern formation operation is performed that forms a pattern such as a stitch, an embroidery pattern, or the like in the work cloth 100 that is held by the embroidery frame 34. In a case where an ordinary pattern, instead of an embroidery pattern, is sewn, the embroidery frame transfer unit 92 may be detached from the bed 11. Ordinary sewing is then performed while the work cloth 100 is fed by the feed dog.

The front face of the pillar 12 is provided with a liquid crystal display 15 that has a vertically long rectangular shape. Illustrations and names of commands that cause various types of commands to be executed are displayed on the liquid crystal display 15. The various types of commands may be used, for example, to set and edit various patterns and to control the sewing work. Various types of set values that pertain to sewing, various types of messages, a step forward/back screen 120 that will be described below and the like are displayed on the liquid crystal display 15.

A touch panel 26 is provided on the front face of the liquid crystal display 15. A plurality of patterns, function names for executing various types of functions, operation keys that are used to perform various types of settings, and the like may be displayed on the liquid crystal display 15. By using one of a finger and a special touch pen to touch a position on the touch panel 26 that corresponds to one of a pattern display portion and various types of keys on a screen that is displayed on the liquid crystal display 15, the user may select a sewing pattern, instruct a function to be executed, set a numerical value, and the like. Hereinafter, an operation of touching the touch panel 26 is referred to as a "panel operation."

A configuration of the arm 13 will be explained. A top cover 16 to be opened and closed is attached to the top of the arm 13. The top cover 16 is provided in the longitudinal direction of the arm 13. The top cover 16 is axially supported at the rear upper edge of the arm 13 such that the top cover 16 may be opened and closed around the right-left directional axis. A thread spool housing 18 is provided close to the middle of the top of the arm 13 under the top cover 16. The thread spool housing 18 is a recessed portion for housing a thread spool 20 that supplies a thread to the sewing machine 1. A spool pin 19, which projects toward the head 14, is disposed on an inner face of the thread spool housing 18 on the pillar 12 side. The thread spool 20 may be attached to the spool pin 19 when the spool pin 19 is inserted through an insertion hole (not shown in the drawings) that is formed in the thread spool 20. An upper thread 17 that extends from the thread spool 20 may be supplied to a needle 7 (refer to FIG. 2) through a tensioner (not shown in the drawings), a thread guide portion 613 of a thread take-up spring 61 (refer to FIGS. 3 to 5, described below), a thread take-up lever 27, and the like. The tensioner is provided in the head 14 and adjusts thread tension. The thread take-up lever is driven reciprocally up and down and pulls the thread up. The needle 7 may be mounted in the needle bar 6. The needle bar 6 is driven up and down by a needle bar up-and-down drive mechanism (not shown in the drawings) that is provided in the head 14. The needle bar up-and-down drive mechanism is driven by a drive shaft (not shown in the drawings) that is rotationally driven by a sewing machine motor 85 (refer to FIG. 6).

As shown in FIG. 1, a sewing start switch 21, a reverse stitch switch 22, a needle up-and-down switch 23, a presser foot elevation switch 24, and the like are provided at the bottom of the front face of the arm 13. The sewing start switch 21 may be used to start the operation of the sewing machine 1, that is, to instruct starting of sewing. The reverse stitch switch 22 may be used to input an instruction of feeding the work cloth 100 from the rear to the front, which is opposite to the normal feed direction. The needle up-and-down switch 23 may be used to input an instruction of switching between raising and lowering a stop position of the needle bar 6 (refer to FIG. 2). The presser foot elevation switch 24 may be used to instruct raising and lowering a presser foot 47 (refer to FIG. 2). A speed controller 32 is provided in the center of the bottom of the front face of the arm 13. The speed controller 32 may be used to adjust a speed, that is, a rotary speed of the drive shaft, when the needle bar 6 (refer to FIG. 2) is driven up and down.

The sewing machine 1 is provided with various types of sensors, such as a presser foot sensor (not shown in the drawings), an overload sensor (not shown in the drawings), and the like, by which various types of errors may be detected. The presser foot sensor detects that the presser foot 47 is in a raised position (refer to FIG. 2). The overload sensor detects that the sewing machine motor 85 (refer to FIG. 6) has locked due to thread tangling or the like.

Figure 2:
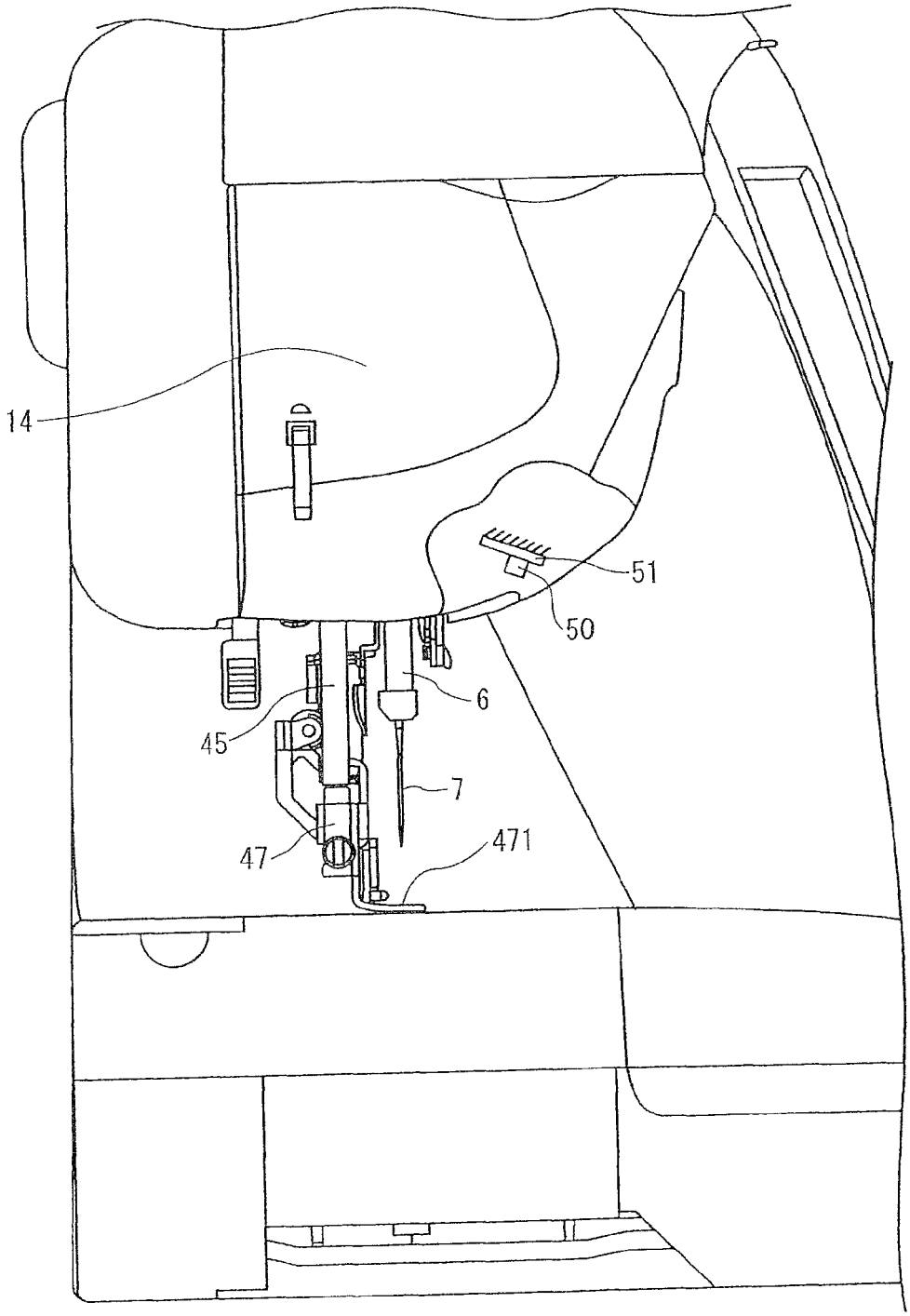
FIG. 2 is a left side view of a main portion of the sewing machine that shows a needle bar; a needle, a presser bar, and a presser foot, as well as a vicinity of the needle bar, the needle, the presser bar, and the presser foot.

The needle bar 6, the needle 7, a presser bar 45, the presser foot 47, and the surrounding area will be explained with reference to FIG. 2. The needle bar 6 and the presser bar 45 are provided on the underside of the head 14. The needle 7 may be attached to the bottom end of the needle bar 6. The presser foot 47, which may hold down the work cloth 100, may be attached to the bottom end of the presser bar 45. A lower portion 471 of the presser foot 47 is made of a transparent resin such that an image may be captured of the work cloth 100 and stitches underneath the presser foot 47. An image sensor 50 is provided such that the image sensor 50 may capture an image of the area that includes the needle drop point of the needle 7. The needle drop point is the point at which the needle 7 is moved downward by the needle bar up-and-down drive mechanism and pierces the work cloth 100. The image sensor 50 includes a CMOS (Complementary Metal Oxide Semiconductor) sensor and a control circuit. An image may be captured by the CMOS sensor. In the present embodiment, as shown in FIG. 2, a support frame 51 is attached to a frame (not shown in the drawings) of the sewing machine 1. The image sensor 50 is fixed to the support frame 51.

Figure 3:
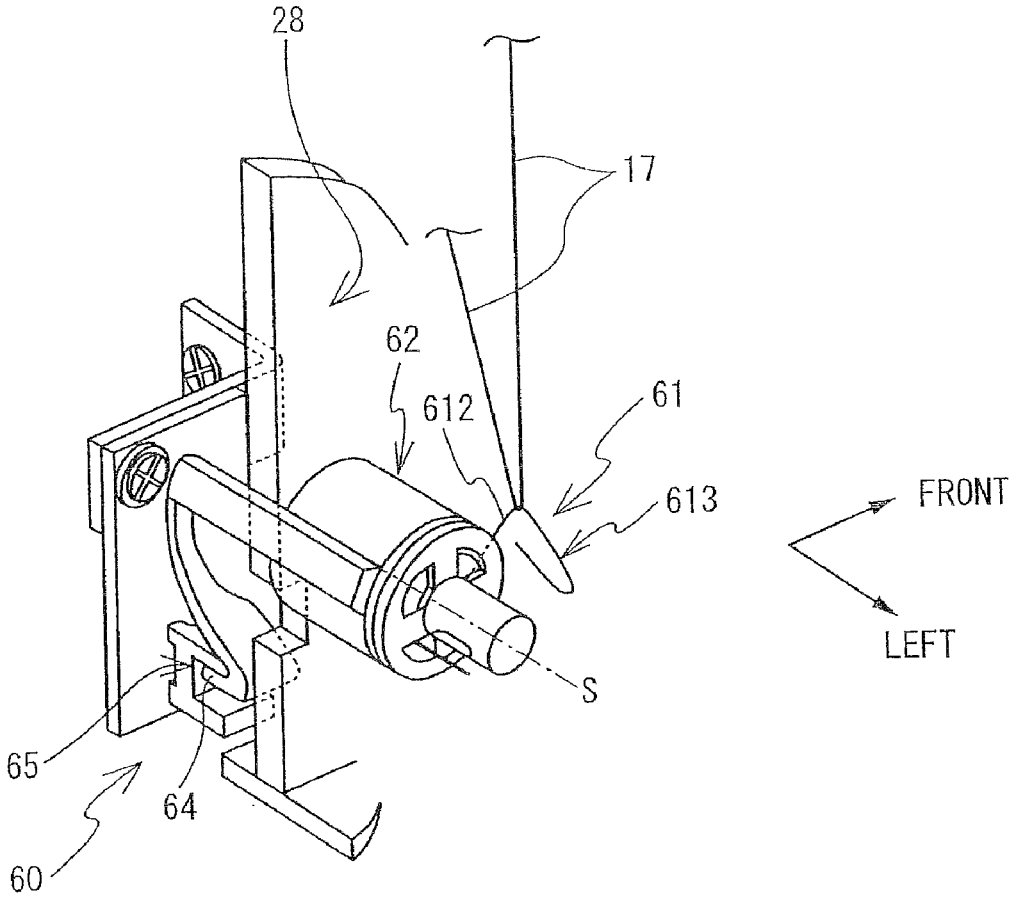
FIG. 3 is an oblique view of a thread break sensor from above and behind.
Figure 4:
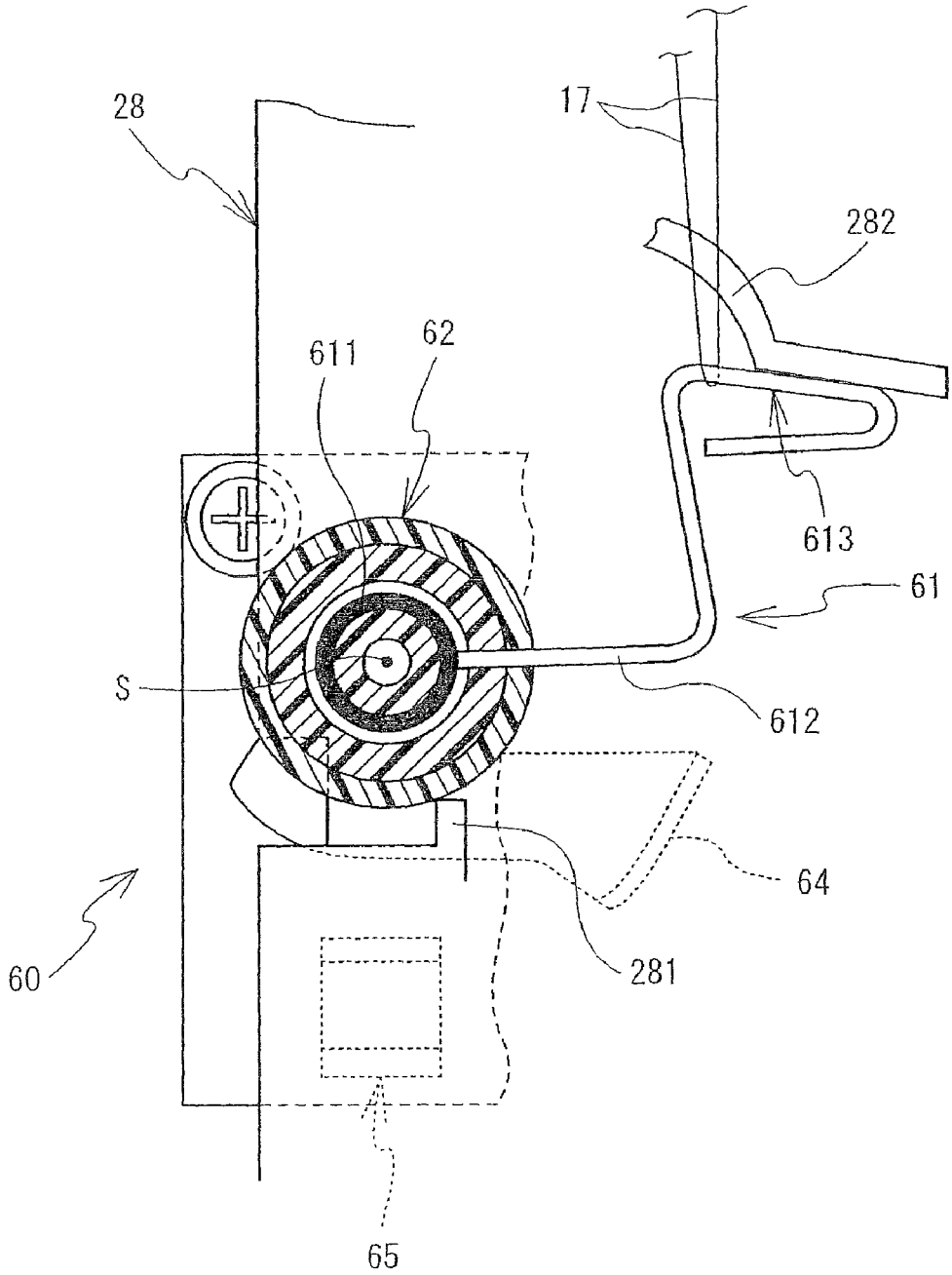
FIG. 4 is a sectional view of the thread break sensor in a state in which a shutter is not detected by a photointerrupter.
Figure 5:
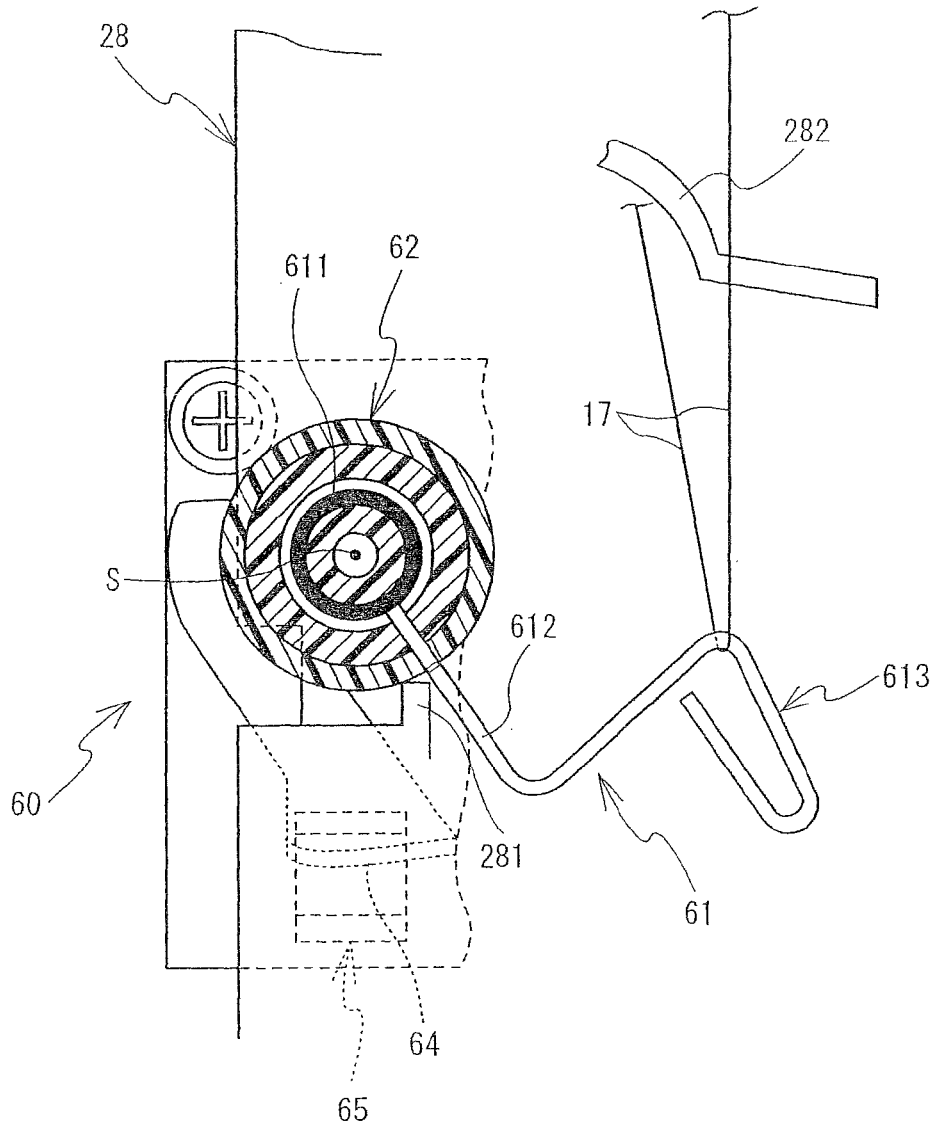
FIG. 5 is a sectional view of the thread break sensor in a state in which the shutter is detected by the photointerrupter.

The thread take-up spring 61 and a thread break sensor 60 will be explained with reference to FIGS. 3 to 5. The thread take-up spring 61 and the thread break sensor 60 include known structures, which will be briefly explained. For example, Japanese Laid-Open Patent Publication No. 2000-000386 discloses the thread take-up spring and the thread break sensor, the relevant portions of which are herein incorporated by reference. In FIG. 3, the upper right side, the lower left side, the lower right side, and the upper left side of the page are respectively referred to as the "front side," the "rear side," the "left side," and the "right side." In FIG. 3, the upper side and the lower side of the page are respectively referred to as the "upper side" and the "lower side." A partition wall (not shown in the drawings) for the up-and-down movement and the like of the thread take-up lever 27 (refer to FIG. 1) is formed in the interior of the head 14 of the sewing machine 1. A vertical wall portion 28 that is shown in FIGS. 3 to 5 is formed as a single piece that is continuous with the lower portion of the partition wall. As shown in FIGS. 3 to 5, the thread take-up spring 61 includes a torsion spring portion 611, a lever portion 612, and the thread guide portion 613. The lever portion 612 is bent toward the outside in the radial direction from the torsion spring portion 611. The thread guide portion 613 is formed by bending the end portion of the lever portion 612. The thread guide portion 613 is positioned to the left of the vertical wall portion 28. The upper thread 17 that extends to the thread take-up lever 27 is hooked on the thread guide portion 613, which is moved reciprocally up and down around a shaft center S in synchronization with the thread take-up lever 27. The torsion spring portion 611 is positioned to the left of the vertical wall portion 28. The torsion spring portion 611 rotationally urges the thread guide portion 613 such that the thread guide portion 613 is moved downward. The thread break sensor 60 includes a rotating member 62, a shutter 64, and a photointerrupter 65. The shutter 64 extends from the rotating member 62 at the right of the vertical wall portion 28. The photointerrupter 65 is provided at the right side of the vertical wall portion 28 and is a detection sensor that is capable of detecting the shutter 64. The rotating member 62 and the shutter 64 are rotated around the shaft center S together along with the thread guide portion 613. The photointerrupter 65 is provided with a light-emitting portion and a light-receiving portion in upper and lower positions. The shutter 64 is detected when the shutter 64 interrupts light between the light-emitting portion and the light-receiving portion of the photointerrupter 65.

As shown in FIGS. 4 and 5, a first restricting portion 281 and a second restricting portion 282 are integrally formed on the left face of the vertical wall portion 28 and project to the left. The first restricting portion 281 restricts the downward movement of the thread guide portion 613 by blocking the base end portion of the lever portion 612. The second restricting portion 282 restricts the upward movement of the thread guide portion 613 by blocking the thread guide portion 613. The thread guide portion 613 therefore is moved reciprocally up and down along the left face of the vertical wall portion 28. The range of the movement of the thread guide portion 613 is restricted by the first restricting portion 281 and the second restricting portion 282.

During the sewing operation of the sewing machine 1, in a case where the upper thread 17 is not broken, when the thread take-up lever 27 (refer to FIG. 1) is moved upward, the upper thread 17 that extends to the thread take-up lever 27 is pulled upward, and tension is imparted to the upper thread 17. Then, the thread guide portion 613, on which the upper thread 17 is hooked, is moved upward against the rotational urging force of the torsion spring portion 611, and comes into contact with the second restricting portion 282. The rotating member 62 and the shutter 64 are rotated along with the thread guide portion 613. Therefore, when the thread guide portion 613 is moved upward, as shown in FIG. 4, the shutter 64 is moved away from a position between the light-emitting portion and the light-receiving portion of the photointerrupter 65. In this state, the shutter 64 is not detected by the photointerrupter 65.

When the thread take-up lever 27 is moved downward, the upper thread 17 that extends to the thread take-up lever 27 goes slack, and the thread guide portion 613 is moved downward due to the rotational urging force of the torsion spring portion 611. The rotating member 62 and the shutter 64 are rotated along with the thread guide portion 613. Therefore, as shown in FIG. 5, the shutter 64 interrupts the light between the light-emitting portion and the light-receiving portion of the photointerrupter 65. In this state, the shutter 64 is detected by the photointerrupter 65.

Thus, in a case where the upper thread 17 is not broken, that is, in a case where the sewing is being normally performed, a cycle in which the shutter 64 is detected and not detected by the photointerrupter 65 is repeated at a specified time interval (once per stitch). A determination is thus made that a thread break has not occurred.

On the other hand, in a case where the upper thread 17 is broken, even if the thread take-up lever 27 is moved upward, tension is not imparted to the upper thread 17 that extends to the thread take-up lever 27. Therefore, the thread guide portion 613 is not moved upward. Therefore, the thread guide portion 613 is subject to the rotational urging force of the torsion spring portion 611, which causes the base end portion of the lever portion 612 to come into contact with the first restricting portion 281, as shown in FIG. 5. The shutter 64 comes to a stop at the position at which the shutter 64 interrupts the light between the light-emitting portion and the light-receiving portion of the photointerrupter 65. In this state, the shutter 64 is continually detected by the photointerrupter 65 for a certain length of time (that is, a length of time in which a plurality of stitches may be sewn). A determination is thus made that a thread break has occurred.

Figure 6:
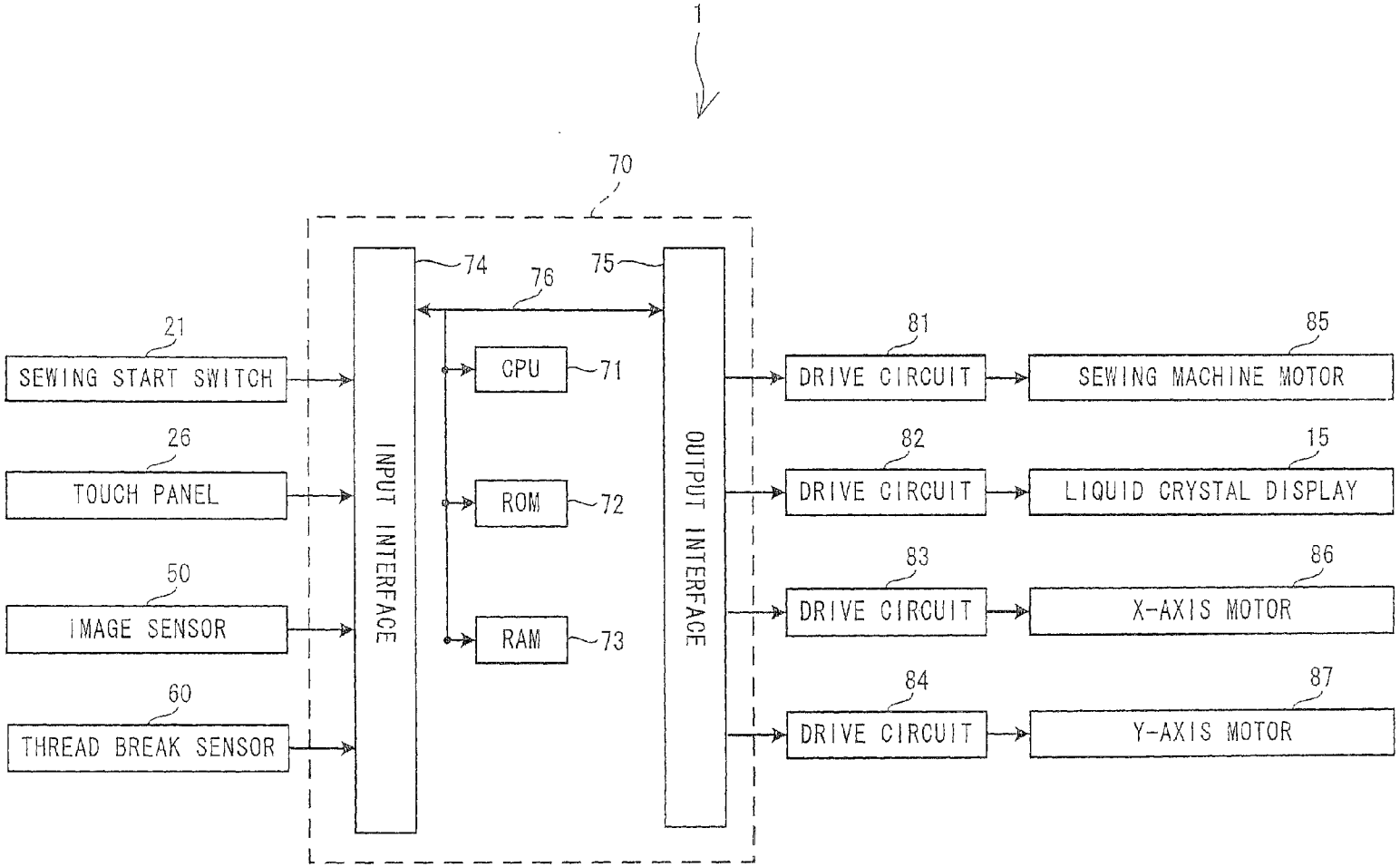
FIG. 6 is a schematic diagram that shows an electrical configuration of the sewing machine.

An electrical configuration of the sewing machine 1 will be explained with reference to FIG. 6. As shown in FIG. 6, a main body 70 of the sewing machine 1 includes a CPU 71, a ROM 72, a RAM 73, an input interface 74, an external interface 75, and the like, which are connected to one another via a bus 76. The sewing start switch 21, the touch panel 26, the image sensor 50, and the thread break sensor 60 are connected to the input interface 74. The reverse stitch switch 22, the needle up-and-down switch 23, the presser foot elevation switch 24, the speed controller 32, the presser foot sensor, the overload sensor, and the like are not shown in FIG. 6.

Drive circuits 81 to 84 are electrically connected to an output interface 75. The drive circuit 81 drives the sewing machine motor 85. The drive circuit 82 drives the liquid crystal display 15. The drive circuits 83 and 84 respectively drive the X-axis motor 86 and the Y-axis motor 87 that transfer the embroidery frame 34. The feed adjustment pulse motor, a drive circuit that drives the feed adjustment pulse motor, and the like are not shown in the drawings.

The CPU 71 conducts main control over the sewing machine 1 and executes various types of computation and processing in accordance with a control program. The control program is stored in a program data storage area 721 (refer to FIG. 7) in the ROM 72. The ROM 72 is a read-only storage element. The RAM 73 is a storage element that can be read from and written to as desired. The RAM 73 includes various types of storage areas that store computation results from computational processing by the CPU 71 as necessary. The sewing start switch 21 is a button switch.

Figure 7:
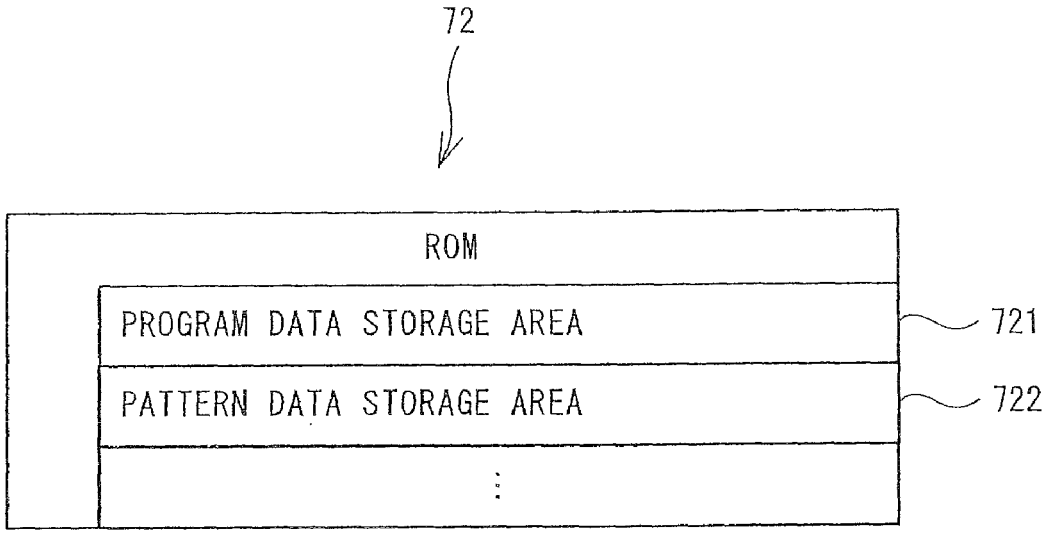
FIG. 7 is a conceptual diagram that shows storage areas of a ROM.

The storage areas which the ROM 72 includes will be explained with reference to FIG. 7. As shown in FIG. 7, the ROM 72 includes the program data storage area 721, a pattern data storage area 722, and other storage areas.

Program data that is required in order for the CPU 71 (refer to FIG. 6) to perform sewing processing for an embroidery pattern and the like (refer to FIGS. 9 and 10) is stored in the program data storage area 721. A pattern data set for each of embroidery patterns is classified according to the type of each of the embroidery patterns and is stored in the pattern data storage area 722. The pattern data set for each of the embroidery patterns includes a counter value N and coordinate data $(X_N, Y_N)$, as in a sample pattern data set 111 that is shown in FIG. 12. The counter value N indicates the order in which the needle drop point is changed. The coordinate data $(X_N, Y_N)$ is allocated to each counter value N and indicates coordinates of a needle drop point on the work cloth 100. The sample pattern data set 111 will be described below.

Figure 8:
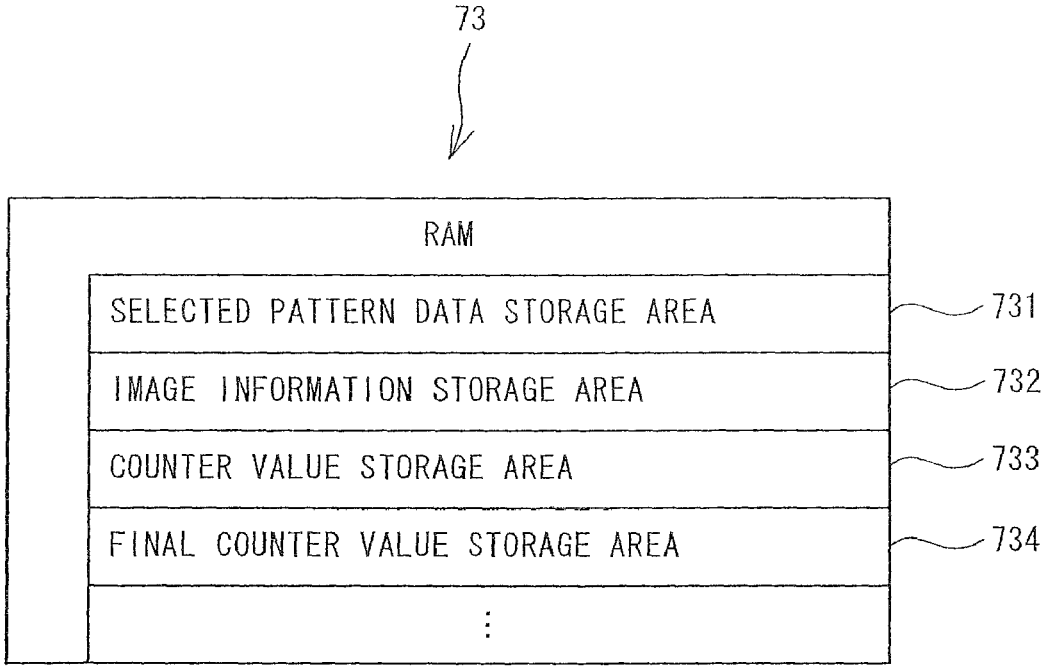
FIG. 8 is a conceptual diagram that shows storage areas of a RAM.

Storage areas which the RAM 73 includes will be explained with reference to FIG. 8. As shown in FIG. 8, the RAM 73 includes a selected pattern data storage area 731, a image information storage area 732, a counter value storage area 733, a final counter value storage area 734, and other storage areas.

A plurality of the pattern data sets are stored in the pattern data storage area 722 of the ROM 72 (refer to FIG. 7). A pattern data set (refer, for example, to the sample pattern data set 111 in FIG. 12) for an embroidery pattern that is selected by a panel operation is read out from the pattern data storage area 722 of the ROM 72 and is stored in the selected pattern data storage area 731. Information for an image of an area that includes the needle drop point that is obtained as a result of image capture by the image sensor 50 is stored in the image information storage area 732. The counter value N is stored in the counter value storage area 733. A final counter value M is stored in the final counter value storage area 734. The final counter value M is the last value of counter values N in a pattern data set (refer, for example, to the sample pattern data set 111 in FIG. 12). Accordingly, the final counter value M is a counter value N that corresponds to coordinates of a last needle drop point in an embroidery pattern.

Figure 9:
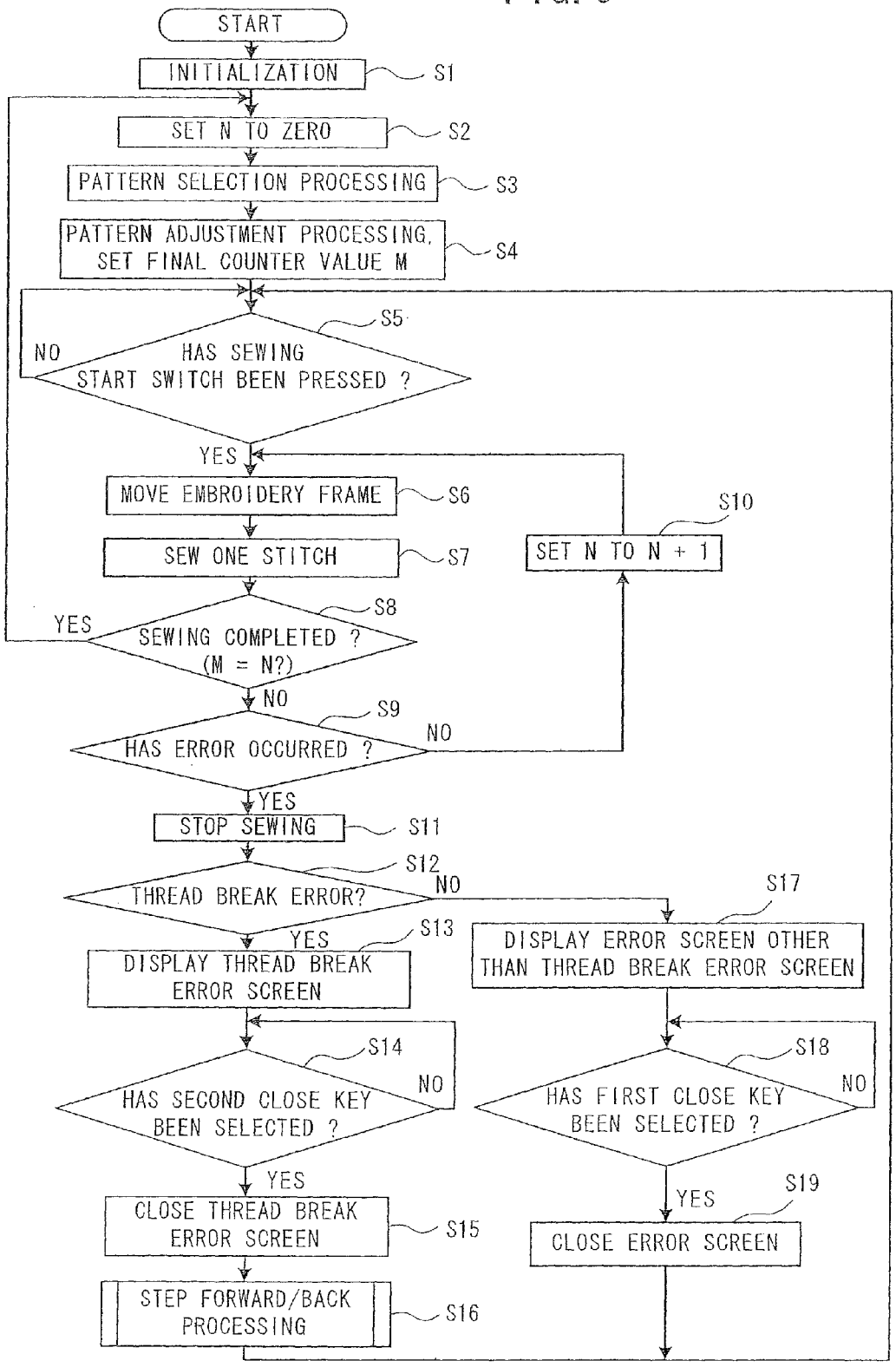
FIG. 9 is a flowchart that shows embroidery sewing processing.
Figure 10:
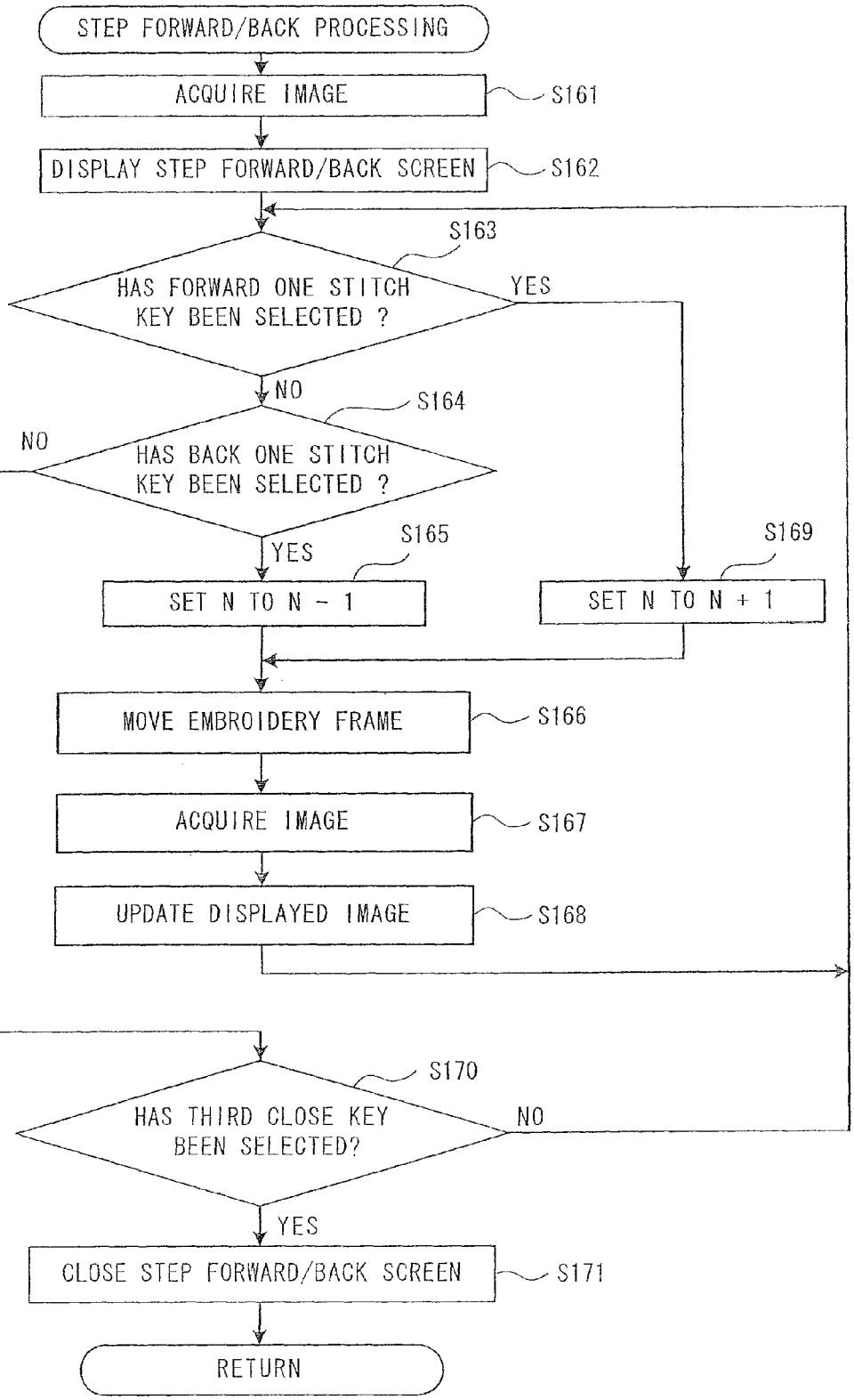
FIG. 10 is a flowchart that shows step forward/back processing.

The operation of the sewing machine 1 in the present embodiment will be explained with reference to flowcharts that are shown in FIGS. 9 and 10.

Figure 11:
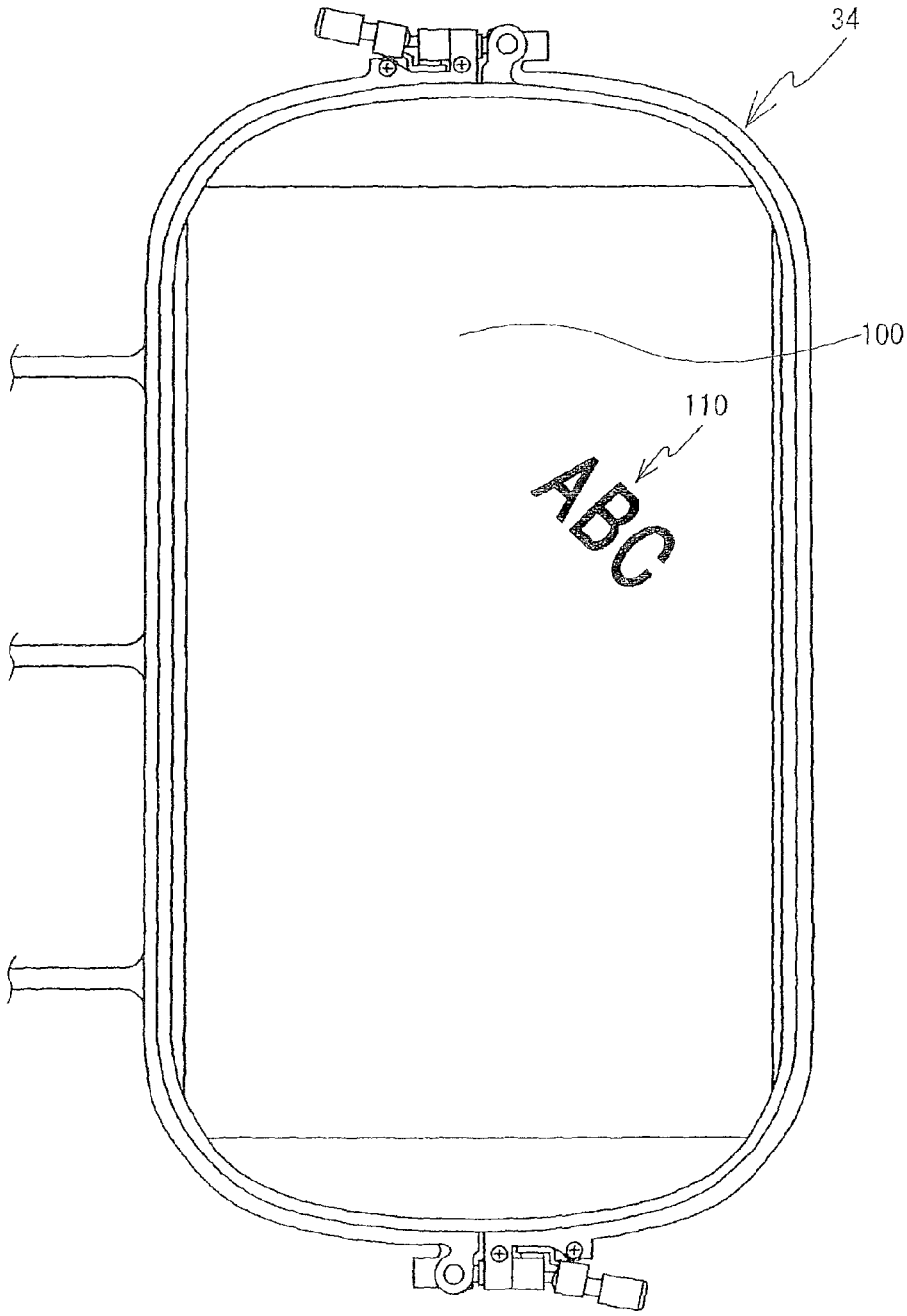
FIG. 11 is a figure that shows a sample embroidery pattern on a work cloth.

As an example, a case is considered in which an embroidery pattern is sewn that forms the three letters "ABC," as shown in FIG. 11. After sewing of the embroidery pattern is started, the letter "A" of the "ABC" has been sewn, and then a thread break occurs while the letter "B" is being sewn. Adjustment of the needle drop point is performed after the thread break occurs. In this case, after the needle drop point is moved back by fifteen stitches, the needle drop point is moved forward by two stitches, and then the sewing is restarted.

As shown in FIG. 9, in the embroidery sewing processing in the present embodiment, initialization is performed first (Step S1). Specifically, initialization of the RAM 73, the liquid crystal display 15, and the like is performed. Next, the counter value N is set to zero and is stored in the counter value storage area 733 of the RAM 73 (refer to FIG. 8) (Step S2).

Next, pattern selection processing is performed (Step S3). In the pattern selection processing, the CPU 71 reads out the pattern data sets that are stored in the pattern data storage area 722 of the ROM 72 (refer to FIG. 7) for the embroidery patterns. The CPU 71 then controls the drive circuit 82 such that the embroidery patterns for which the pattern data sets have been read out are displayed on the liquid crystal display 15 (Step S3). By performing a panel operation, the user may select the desired embroidery pattern from among the embroidery patterns that are displayed on the liquid crystal display 15. Information as to which of the embroidery patterns has been selected is detected by the touch panel 26 (refer to FIG. 6) and is recognized by the CPU 71 (Step S3). From a screen for performing the pattern selection processing, it is also possible to shift to another mode and to terminate the use of the sewing machine 1, although the screen is not shown in the drawings and an explanation of the screen is omitted.

In the example, it is assumed that an embroidery pattern that forms the three letters "ABC," as shown in FIG. 11, is selected from among the embroidery patterns by the user (Step S3).

Next, pattern adjustment processing is performed such as settings of a sewing start position, the size of the embroidery pattern, the angle of the embroidery pattern, and the like (Step S4). Specifically, a positioning key, a size key, a rotation key, which are not shown in drawings, and the like are displayed on the liquid crystal display 15. The positioning key is used for setting the position where the embroidery pattern is to be sewn. The size key is used for setting the size of the embroidery pattern. The rotation key is used for setting the angle of the embroidery pattern. The embroidery pattern that has been adjusted by the positioning key, the size key, the rotation key, and the like is displayed at the same time. A pattern determination key (not shown in the drawings) is also displayed at the same time. The pattern determination key is used for determining the embroidery pattern to be sewn after the pattern adjustment processing has been performed.

A key that is selected by a panel operation is detected by the touch panel 26 and is recognized by the CPU 71. In a case where the positioning key has been selected, the position of the embroidery pattern that is displayed on the liquid crystal display 15 is changed. While checking the embroidery pattern that is displayed on the liquid crystal display 15, the user may set the position on the work cloth 100 where the embroidery pattern is to be sewn. In a case where one of the size key and the angle key has been selected, the corresponding one of the size and the angle of the embroidery pattern is adjusted, and the adjusted embroidery pattern is displayed on the liquid crystal display 15. Then, when the pattern determination key is selected, a pattern data set (a default pattern data set) that has been read out from the pattern data storage area 722 of the ROM 72 (refer to FIG. 7) is converted to the pattern data set that is required in order to sew the embroidery pattern after the pattern adjustment processing (refer, for example, to the sample pattern data set 111 in FIG. 12). The converted pattern data set is stored in the selected pattern data storage area 731 of the RAM 73 (refer to FIG. 8). Then the final counter value M is set and is stored in the final counter value storage area 734. In this manner, the embroidery pattern that is to be sewn on the work cloth 100 is determined.

In the example, it is assumed that the embroidery pattern "ABC" that was selected by the processing at Step S3 has been adjusted as shown in FIG. 11, such that the embroidery pattern is rotated forty-five degrees to the right and is positioned slightly to the right rear (to the upper right in FIG. 11) from the center of the embroidery frame 34 (Step S4). Hereinafter, the embroidery pattern that has been adjusted in this manner is referred to as the sample embroidery pattern 110. When the pattern determination key is selected, the pattern data set (a default pattern data set) for the embroidery pattern "ABC" is read out from the pattern data storage area 722 of the ROM 72. The pattern data set that has been read out is converted into the sample pattern data set 111 (refer to FIG. 12), and the sample pattern data set 111 is stored in the selected pattern data storage area 731 of the RAM 73 (Step S4). The sample pattern data set 111 is a pattern data set for sewing the sample embroidery pattern 110. Further, the final counter value M is set to 1500, which is the counter value N that corresponds to coordinates of the last needle drop point for embroidery sewing in the sample pattern data set 111 in FIG. 12, and the set final counter value M is stored in the final counter value storage area 734 of the RAM 73 (refer to FIG. 8) (Step S4).

The sample pattern data set 111 that are shown in FIG. 12 will be explained. As shown in FIG. 12, and as explained above, the sample pattern data set 111 includes counter values N and coordinate data $(X_N, Y_N)$. The coordinate data $(X_N, Y_N)$ is actually data that indicates a specific coordinate position, but is simply indicated as the coordinate data $(X_N, Y_N)$. The coordinate $X_N$ indicates a position of the needle drop point in the right-left direction on the work cloth 100 in FIG. 11. The coordinate $Y_N$ indicates a position of the needle drop point in the up-down direction the work cloth 100 in FIG. 11.

As described below, in a case where the embroidery sewing is performed based on the sample pattern data set 111, the counter value N that is stored in the counter value storage area 733 is increased in increments of one, such that the counter value N becomes 0, 1, 2, 3, and the like (at Step S10 in FIG. 9). The embroidery frame 34 is then transferred such that a needle drop point on the work cloth 100 is at the position that is indicated by the coordinate data $(X_N, Y_N)$ that corresponds to the counter value N (at Step S6 in FIG. 9). Thereafter, the sewing is performed (at Step S7 in FIG. 9). When the sewing has been performed such that the counter value N has been increased from zero to 1500, the sample embroidery pattern 110 that is shown in FIG. 11 is completed. In the example, when the sewing has been performed such that the counter value N has been increased from zero to 499, the embroidery pattern "A" is completed. When the sewing has been performed such that the counter value N has been increased from 500 to 999, the embroidery pattern "B" is completed. When the sewing has been performed such that the counter value N has been increased from 1000 to 1500, the embroidery pattern "C" is completed.

As shown in FIG. 9, once the pattern selection processing and the like have been performed (Step S4), a determination is made as to whether the sewing start switch 21 has been pressed (Step S5). If the sewing start switch 21 has not been pressed (NO at Step S5), the CPU 71 returns to Step S5. In other words, the sewing machine 1 is on standby while the sewing start switch 21 is not pressed (NO at Step S5).

If the sewing start switch 21 has been pressed (YES at Step S5), the embroidery frame 34 is transferred to the position at which the sewing will be performed (Step S6). Specifically, the sample pattern data set 111 (refer to FIG. 12) is read out from the selected pattern data storage area 731 of the RAM 73 (refer to FIG. 8). The embroidery frame 34 is then transferred such that the needle drop point on the work cloth 100 is at the position that is indicated by the coordinate data $(X_N, Y_N)$ that corresponds to the counter value N. The CPU 71 controls the drive circuits 83 and 84, which respectively drive the X-axis motor 86 and the Y-axis motor 87, so that the embroidery frame 34 is transferred (refer to FIG. 6). When the processing at Step S6 is performed for the first time, the counter value N that is stored in the counter value storage area 733 is zero. Therefore, the embroidery frame 34 is transferred such that the needle drop point is at the position that is indicated by the coordinate data $(X_0, Y_0)$.

Next, the sewing of one stitch is performed (Step S7). Specifically, the CPU 71 controls the drive circuit 81, which drives the sewing machine motor 85 (refer to FIG. 6). The sewing machine motor 85 drives the needle bar up-and-down drive mechanism (not shown in the drawings), which drives the needle bar 6 (refer to FIG. 2) such that the needle bar 6 is moved up and down. In this manner, the sewing of one stitch is performed.

Then, a determination is made as to whether the sewing has been completed (Step S8). Specifically, a determination is made as to whether the counter value N is equal to the final counter value M. If the counter value N is equal to the final counter value M, it is determined that the sewing has been completed. In the example, when the first stitch has been sewn, the counter value N is zero, and the final counter value M is 1500. Therefore, the counter value N is not equal to the final counter value M. It is therefore determined that the sewing has not been completed (No at Step S8).

If it is determined that the sewing has not been completed (No at Step S8), a determination is made as to whether an error has occurred (Step S9). Specifically, one of a thread break error, a presser foot error, an overload error, and the like may be detected. The thread break error is detected when the upper thread 17 has broken. The presser foot error is detected when the presser foot 47 is switched to the raised position due to an operational mistake. The overload error is detected when the sewing machine motor 85 has been locked due to thread tangling or the like. If an error has not occurred (NO at Step S9), the counter value N that is stored in the counter value storage area 733 of the RAM 73 (refer to FIG. 8) is increased by one and is stored in the counter value storage area 733 (Step S10). Next, the CPU 71 returns to Step S6 and repeatedly performs the processing at Steps S6 to S10. Thus the sewing is continued.

In the example, an error does not occur when the first stitch is sewn (NO at Step S9). Therefore, the counter value N is increased by one to be one, which is stored in the counter value storage area 733 (Step S10). Next, the CPU 71 returns to Step S6, and the sewing is continued.

In the example, it is assumed that the sewing is normally performed until the counter value N reaches 510 and that the upper thread 17 is broken when the counter value N is 511. In this case, of the three letters "ABC" in the sample embroidery pattern 110, the embroidery pattern "A" has been completed, and the thread is broken while the sewing of the embroidery pattern "B" is in progress. As described above with reference to FIGS. 3 to 5, in a case where the upper thread 17 has been broken, tension is not imparted to the upper thread 17 that extends to the thread take-up lever 27, even if the thread take-up lever 27 is moved upward. Therefore, the thread guide portion 613 is not moved up. At this time, the base end portion of the lever portion 612 that is continuous with the thread guide portion 613 is brought into contact with the first restricting portion 281 by the rotational urging force of the torsion spring portion 611. Therefore, the shutter 64 is stopped at the position where the shutter 64 interrupts the light between the light-emitting portion and the light-receiving portion of the photointerrupter 65 (refer to FIG. 5). In this state, the shutter 64 is continually detected by the photointerrupter 65 for a certain length of time (that is, a length of time in which a plurality of stitches may be sewn). A signal that the shutter 64 has been continuously detected by the photointerrupter 65 for a certain length of time is transmitted to the CPU 71 by the thread break sensor 60 (refer to FIG. 6). A determination is thus made that a thread break error has occurred.

After the upper thread 17 is broken, a certain length of time elapses until the determination is made that the thread break error has occurred, in that time, the counter value N that is stored in the 733 is increased a plurality of times. In other words, because the upper thread 17 has been broken, the work cloth 100 is transferred and the needle drop point is advanced with no stitches being formed on the work cloth 100. In the example, it is assumed that the counter value N is increased by ten. In other words, the upper thread 17 is broken when the counter value N is 511, and it is determined that the thread break error has occurred when the counter value N is 520.

If it is determined that a thread break error has occurred (YES at Step S9), sewing stop processing is performed (Step S11). The sewing stop processing is performed (Step S11) if it is determined that an error other than the thread break error has occurred (YES at Step S9). Specifically, the CPU 71 transmits stop commands to the drive circuits 81, 83, and 84 to stop the sewing machine motor 85, the X-axis motor 86, and the Y-axis motor 87. The embroidery sewing is thus stopped.

In the example, the counter value N is 511 when the upper thread 17 is broken. After the determination is made that the thread break error has occurred (YES at Step S9), the counter value N is 520 when the sewing is stopped (Step S11). Therefore, stitches that correspond to the values 511 to 520 for the counter value N are not formed on the work cloth 100. In order to restart the sewing after where a thread break error has occurred, the user needs to perform threading of the upper thread 17 and change the needle drop point to a position where the thread break error occurred.

Next, a determination is made as to whether the error that has occurred is the thread break error (Step S12). A case is considered where an error other than the thread break error has occurred, such as the presser foot error, the overload error, or the like. If the error that has occurred is not the thread break error (NO at Step S12), an error screen (not shown in the drawings) is displayed on the liquid crystal display 15 (Step S17). Specifically, in a case where the overload error has occurred, for example, an error screen that is provided with a message (not shown in the drawings) such as "Is the thread tangled?" or the like, as well as a first close key (not shown in the drawings), is displayed on the liquid crystal display 15. The first close key is a key that is expressed as "CLOSE," for example, and the first close key is used for terminating the display of the error screen. Data for this sort of error screen is stored in the program data storage area 721 of the ROM 72 (refer to FIG. 7), the data is read out by the CPU 71, and the error screen is displayed on the liquid crystal display 15. The user may check the message that is indicated on the error screen and may take an action, such as untangling the thread or the like.

Once the error screen is displayed (Step S17), a determination is made as to whether the first close key has been selected (Step S18). If the first close key has not been selected (NO at Step S18), the CPU 71 returns to Step S18. In other words, the sewing machine 1 is on standby while the first close key is not selected by a panel operation (NO at Step S18).

If the first close key has been selected by a panel operation (YES at Step S18), the display of the error screen is terminated (Step S19). Specifically, the display of the error screen on the liquid crystal display 15 is stopped by the CPU 71. Next, the CPU 71 returns to Step S5 and repeatedly performs the processing.

In the example, the thread break error has occurred (YES at Step S12), so a thread break error screen (not shown in the drawings) is displayed (Step S13). A message for indicating that the thread break error has occurred and a second close key are displayed on the thread break error screen. The second close key is a key that is expressed as "CLOSE," for example, and the second close key is used for terminating the display of the thread break error screen. Data for the thread break error screen is stored in the program data storage area 721 of the ROM 72 (refer to FIG. 7), the data is read out by the CPU 71, and the thread break error screen is displayed on the liquid crystal display 15. The user may see the thread break error screen to confirm that the thread break error has occurred.

Once the thread break error screen is displayed (Step S13), a determination is made as to whether the second close key has been selected (Step S14). If the second close key has not been selected (NO at Step S14), the CPU 71 returns to Step S14. In other words, the sewing machine 1 is on standby, with the thread break error screen being displayed, while the second close key is not selected by a panel operation (NO at Step S14).

If the second close key has been selected (YES at Step S14), the display of the thread break error screen is terminated (Step S15). Specifically, the display of the thread break error screen on the liquid crystal display 15 is stopped by the CPU 71.

Next, step forward/back processing (hereinafter referred to as step F/B processing) is performed (Step S16). Specifically, an image of the area that includes the needle drop point of the needle 7 is captured by the image sensor 50, and the captured image is displayed on the liquid crystal display 15 (refer to FIGS. 13 to 15). The user may adjust the needle drop point of the needle 7 while checking the captured image.

The step F/B processing will be explained with reference to the flowchart in FIG. 10. In the step F/B processing that is shown in FIG. 10, first, the image of the area that includes the needle drop point is acquired (Step S161). Specifically, the image of the area that includes the needle drop point is captured by the image sensor 50 (refer to FIGS. 2 and 6) and is stored in the image information storage area 732 of the RAM 73 (refer to FIG. 8).

Next, the step F/B screen 120 (refer to FIG. 13) is displayed on the liquid crystal display 15 (Step S162). The image of the area that includes the needle drop point that is stored in the image information storage area 732, a forward one stitch key 122 (refer to FIG. 13), and a back one stitch key 123 (refer to FIG. 13) are displayed on the step F/B screen 120. In a case where the thread break error has occurred, the processing at Steps S161 and S162 is automatically performed, and the step F/B screen 120 is displayed. It is therefore not necessary for the user to perform an operation such as pressing a button or the like. The user may check the needle drop point by looking at the image of the area that includes the needle drop point that is displayed on the step F/B screen 120, without looking directly at the needle drop point.

Figure 13:
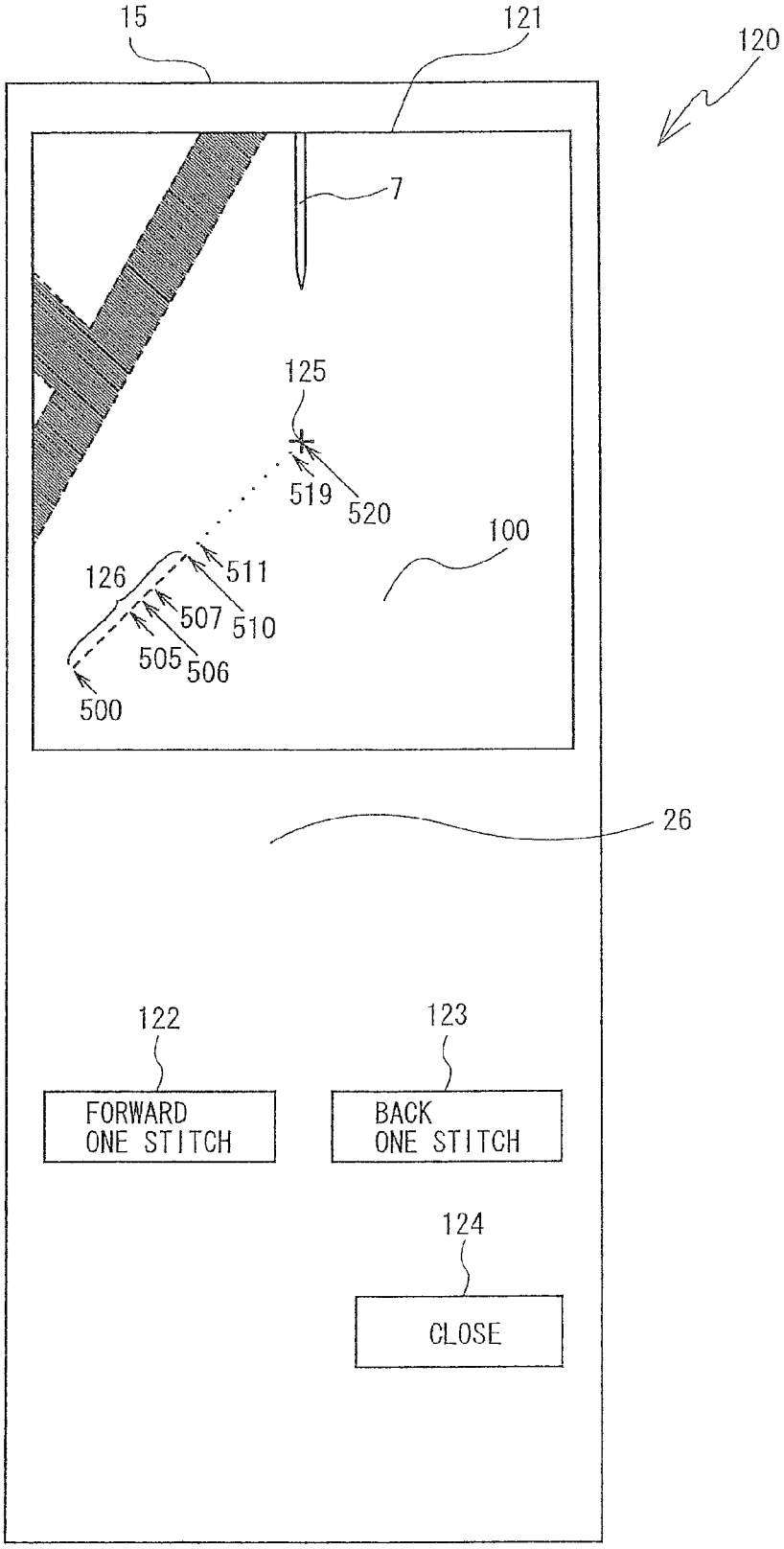
FIG. 13 is a figure that shows a step forward/back screen.

The step F/B screen 120 that is displayed by the processing at Step S162 in FIG. 10 will be explained with reference to FIG. 13. In FIG. 13, the upper side, the lower side, the right side, and the left side of the page is respectively referred to as the upper side, the lower side, the right side, and the left side of the liquid crystal display 15. The front side and the rear side of the page are respectively referred to as the front side and the rear side of the liquid crystal display 15.

As shown in FIG. 13, the touch panel 26 is provided on the front face of the liquid crystal display 15. An image display area 121 is provided in roughly the upper half of the liquid crystal display 15. The image of the area that includes the needle drop point that has been captured by the image sensor 50 is displayed in the image display area 121. The image of the area that includes the needle drop point in the example will be described below. The forward one stitch key 122 is displayed below the image display area 121 in the left-hand portion of the liquid crystal display 15. The forward one stitch key 122 is a key that is expressed as "forward one stitch," and the user may select the forward one stitch key 122 by a panel operation to move the needle drop point forward by one stitch. "Move the needle drop point forward by one stitch" means "change the needle drop point from the current needle drop point to the next needle drop point." The back one stitch key 123 is displayed to the right of the forward one stitch key 122. The back one stitch key 123 is a key that is expressed as "back one stitch," and the user may select the back one stitch key 123 by a panel operation to move the needle drop point back by one stitch. "Move the needle drop point back by one stitch" means "change the needle drop point from the current needle drop point to the previous needle drop point." In addition, a third close key 124 is displayed below the back one stitch key 123. The third close key 124 is a key that is expressed as "CLOSE," and the user may select the third close key 124 by a panel operation to terminate the display of the step F/B screen 120.

The image of the area that includes the needle drop point that is displayed in the image display area 121 in the example will be explained with reference to FIGS. 13 to 15. In the image that is displayed in the image display area 121 in FIGS. 13 to 15, the needle 7 is shown as a part of the sewing machine 1, while a part other than the needle 7, such as the presser foot 47 and the like, for example, is omitted. A needle drop point mark 125 is displayed approximately in the center of the captured image of the area that includes the needle drop point. The needle drop point mark 125 is a mark that is expressed as a "+," and indicates the needle drop point on the work cloth 100.

In the example, as shown in FIG. 13, the embroidery sewing of the letter "A" of the "ABC" in the sample embroidery pattern 110 (refer to FIG. 11) has been completed, and the thread break occurs while the embroidery sewing of the letter "B" is in progress. The needle drop points that correspond to the values 500 to 520 for the counter value N are respectively referred to as sample needle drop points 500 to 520. In FIGS. 13 to 15, reference characters are omitted for the sample needle drop points 501 to 504, 508, 509, and 512 to 518. The embroidery sewing of the letter "B" has begun at the sample needle drop point 500. On the work cloth 100 that is displayed in the image display area 121, sample stitches 126 that are sewn stitches have been formed at the sample needle drop points 500 to 510. However, the thread break has occurred before the needle 7 pierces the work cloth 100 at the position of the sample needle drop point 511. As described above, after the thread break occurs and the error is detected (YES at Step S9 in FIG. 9), the counter value N is increased to 520 by the time when the sewing is stopped (Step S11 in FIG. 9). Therefore, no stitches are formed at the sample needle drop points 511 to 520. Accordingly, in order to restart the sewing, the user needs to perform threading of the upper thread 17 and change the needle drop point to a position where the thread break error occurred. In the explanation that follows, it is assumed that the user has already performed threading of the upper thread 17. In FIG. 13, the sample needle drop points 511 to 520 are indicated by dots. The position of the sample needle drop point 520 where the sewing was stopped is indicated by the needle drop point mark 125.

The explanation returns to the step F/B processing that is shown in FIG. 10. Once the step F/B screen 120 (refer to FIG. 13) is displayed on the liquid crystal display 15 (Step S162), a determination is made as to whether the forward one stitch key 122 has been selected by a panel operation (Step S163). If the forward one stitch key 122 has not been selected (NO at Step S163), a determination is made as to whether the back one stitch key 123 has been selected by a panel operation (Step S164). If the back one stitch key 123 has not been selected (NO at Step S164), a determination is made as to whether the third close key 124 has been selected by a panel operation (Step S170).

If the third close key 124 has not been selected (NO at Step S170), the CPU 71 returns to Step S163 and repeatedly performs the processing. In other words, the sewing machine 1 is on standby with the step F/B screen 120 being displayed while none of the forward one stitch key 122, the back one stitch key 123, and the third close key 124 has been selected by a panel operation (NO at Step S163, NO at Step S164, NO at Step S170).

In the example, in a case where the needle drop point is moved back by fifteen stitches, the user may select the back one stitch key 123 fifteen times by panel operations.

First, a case will be described in which the back one stitch key 123 is selected one time by a panel operation. If the back one stitch key 123 has been selected (YES at Step S164), the counter value N is decreased by one (Step S165). Specifically, the counter value N that is stored in the counter value storage area 733 of the RAM 73 (refer to FIG. 8) is decreased and stored in the counter value storage area 733 by the CPU 71. Thus, in the example, the counter value N is decreased by one from 520, and 519 is stored as the counter value N in the counter value storage area 733.

Next, the embroidery frame 34 is transferred such that the needle drop point on the work cloth 100 is changed to the position that is indicated by the coordinate data ($X_N$, $Y_N$) shown in FIG. 12 that corresponds to the counter value N (Step S166). Specifically, the coordinate data ($X_N$, $Y_N$) that corresponds to the counter value N in the sample pattern data 111 that is stored in the selected pattern data storage area 731 of the RAM 73 (refer to FIG. 8) are read out by the CPU 71. Then, in the same manner as in the processing at Step S6, the embroidery frame 34 is transferred such that the needle drop point is changed to the position that is indicated by the coordinate data ($X_N$, $Y_N$).

In the example, the counter value N that is stored in the counter value storage area 733 is 519, so the embroidery frame 34 is transferred such that the needle drop point is changed to the position that is indicated by the coordinate data ($X_{519}$, $Y_{519}$). Thus the needle drop point is changed from the position of the sample needle drop point 520 that is shown in FIG. 13 to the position of the sample needle drop point 519. In other words, the needle drop point on the work cloth 100 is moved back by one stitch.

Next, as shown in FIG. 10, the image of the area that includes the needle drop point is acquired (Step S167). Specifically, the image of the area that includes the needle drop point is captured by the image sensor 50 and is stored in the image information storage area 732 of the RAM 73 (refer to FIG. 8) in the same manner as in the processing at Step S161.

In the example, after the needle drop point has been changed to the position of the sample needle drop point 519 (refer to FIG. 13), the image of the area that includes the needle drop point is captured by the image sensor 50 and is stored in the image information storage area 732 of the RAM 73.

Next, the image of the area that includes the needle drop point that is displayed in the image display area 121 (refer to FIG. 13) is updated (Step S168). Specifically, the image of the area that includes the needle drop point that was captured by the processing at Step S167 is displayed in the image display area 121.

In the example, the image in the image display area 121 is updated, and an image is displayed in which the position of the needle drop point mark 125 has been changed to the position of the sample needle drop point 519 by the movement of the embroidery frame 34. This makes it possible for the user to check the current needle drop point by looking at the image of the area that includes the needle drop point that is displayed in the image display area 121. It is therefore possible to check the image of the area that includes the needle drop point every time that the needle drop point is changed. That makes it possible to smoothly perform adjusting the needle drop point.

As shown in FIG. 10, the CPU 71 repeatedly performs the processing at Steps S163, S164, and S170 while none of the forward one stitch key 122, the back one stitch key 123, and the third close key 124 has been selected (NO at Step S163, NO at Step S164, NO at Step S170). In other words, the sewing machine 1 is on standby with the step F/B screen 120 being displayed.

In a case where the back one stitch key 123 is selected by panel operations fourteen times, the processing at Steps S163 to S168 is repeated fourteen times. The counter value N thus becomes 505 (Step S165). The embroidery frame 34 is transferred such that the needle drop point on the work cloth 100 is changed to the position that is indicated by the coordinate data ($X_{505}$, $Y_{505}$) (Step S166). Then the image of the area that includes the needle drop point is captured by the image sensor 50 (Step S167). In the image display area 121, an image is displayed in which the position of the needle drop point mark 125 has been changed to the position of the sample needle drop point 505, as shown in FIG. 14 (Step S168).

The sewing machine 1 is on standby with the step F/B screen 120 being displayed while none of the forward one stitch key 122, the back one stitch key 123, and the third close key 124 is selected (NO at Step S163, NO at Step S164, NO at Step S170).

Figure 14:
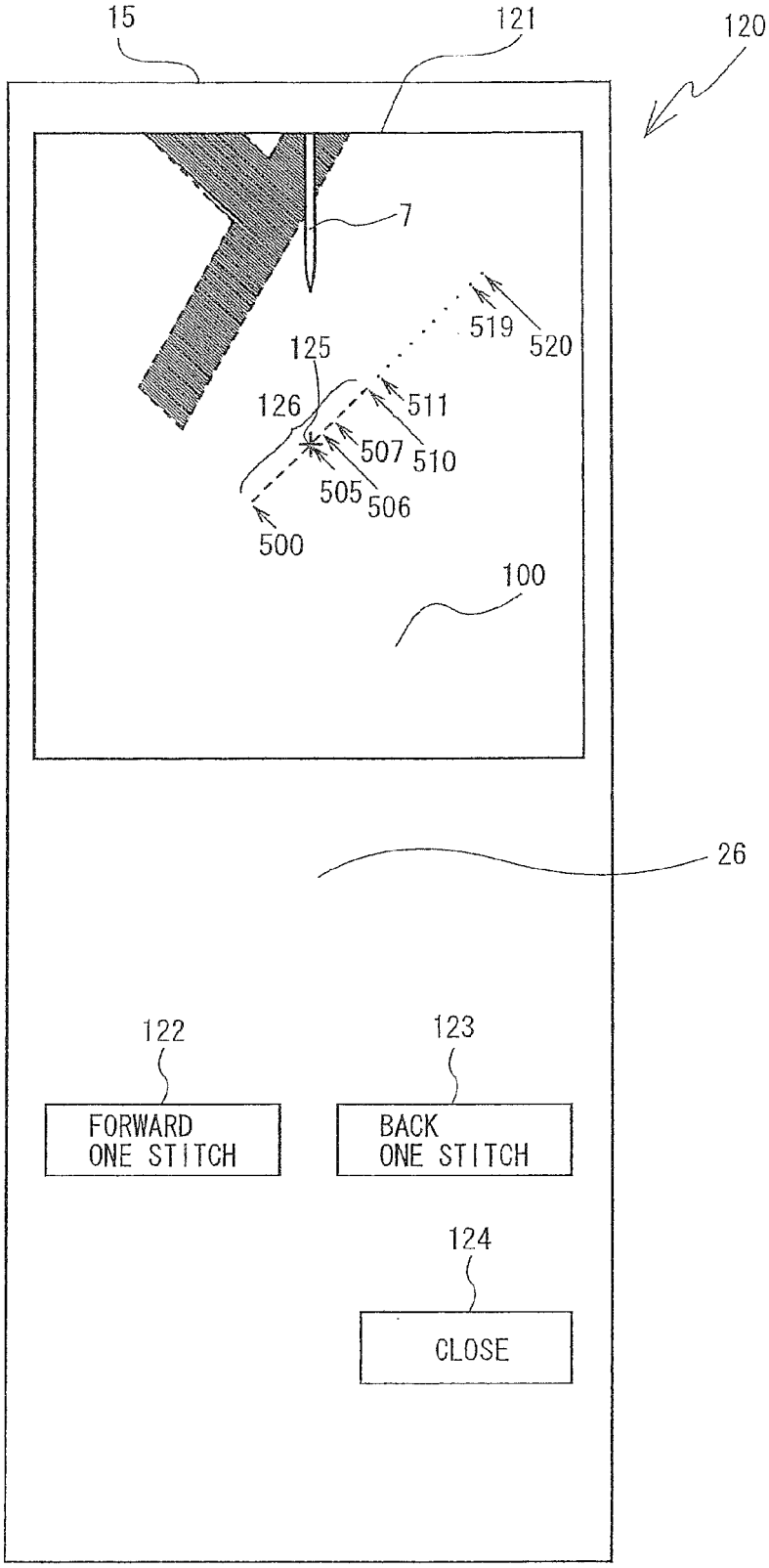
FIG. 14 is a figure that shows the step forward/back screen.

In the example, it is assumed that the user checks the step F/B screen 120 that is shown in FIG. 14 and decides to move the needle drop point forward by two stitches. When the forward one stitch key 122 has been selected (YES at Step S163), the counter value N is increased by one and is stored in the counter value storage area 733 of the RAM 73 (refer to FIG. 8) (Step S169). The counter value N is thus changed from 505 to 506.

Next, the embroidery frame 34 is transferred such that the needle drop point is changed to the position that is indicated by the coordinate data ($X_{506}$, $Y_{506}$) (Step S166). The needle drop point is thus changed from the position of the sample needle drop point 505 (refer to FIG. 14) to the position of the sample needle drop point 506. In other words, the needle drop point is moved forward by one stitch.

Next, the image of the area that includes the needle drop point is captured by the image sensor 50 (Step S167). In the image display area 121, an image is displayed in which the position of the needle drop point mark 125 has been changed from the position of the sample needle drop point 505 to the position of the sample needle drop point 506 (Step S168). The sewing machine 1 is then on standby with the step F/B screen 120 being displayed while none of the forward one stitch key 122, the back one stitch key 123, and the third close key 124 is selected (NO at Step S163, NO at Step S164, NO at Step S170).

When the forward one stitch key 122 has been selected again (YES at Step S163), the counter value N is increased by one from 506 to 507 (Step S169). The embroidery frame 34 is then transferred such that the needle drop point is changed to the position that is indicated by the coordinate data ($X_{507}$, $Y_{507}$) (Step S166). The image of the area that includes the needle drop point is then captured by the image sensor 50 (Step S167), and the image that is displayed in the image display area 121 is updated (Step S168). In the image display area 121, an image is thus displayed in which the position of the needle drop point mark 125 has been changed to the position of the sample needle drop point 507, as shown in FIG. 15. The sewing machine 1 is then on standby with the step F/B screen 120 being displayed while none of the forward one stitch key 122, the back one stitch key 123, and the third close key 124 is selected (NO at Step S163, NO at Step S164, NO at Step S170).

Figure 15:
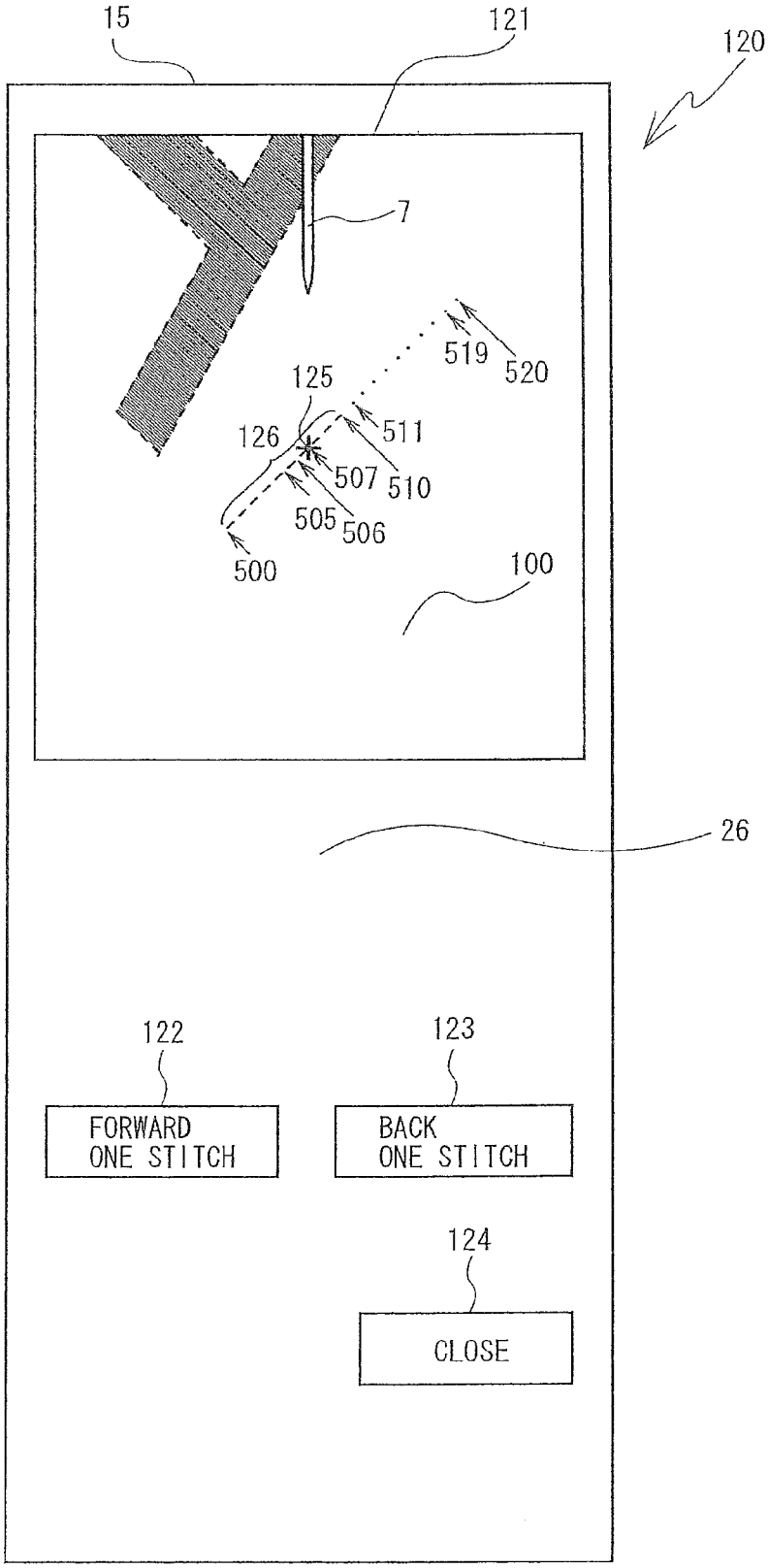
FIG. 15 is a figure that shows the step forward/back screen.

Next, in the example, it is assumed that the user checks the image in which the position of the needle drop point mark 125 has been changed to the position of the sample needle drop point 507 as shown in FIG. 15. It is also assumed that the user then decides to restart the sewing from the position of the sample needle drop point 507 and selects the third close key 124. When the third close key 124 has been selected (YES at Step S170), the display of the step F/B screen 120 is terminated (Step S171). Specifically, the CPU 71 controls the drive circuit 82 (refer to FIG. 6) such that the display of the step F/B screen 120 on the liquid crystal display 15 is stopped.

As shown in FIG. 9, when the step F/B processing (Step S16) is terminated, the CPU 71 returns to the processing at Step S5. The user may press the sewing start switch 21 in order to restart the sewing. The sewing machine 1 is on standby while the sewing start switch 21 is not pressed (NO at Step S5).

In the example, when the sewing start switch 21 is pressed (YES at Step S5), the embroidery frame 34 is transferred such that the position of the needle drop point on the work cloth 100 is changed to the position that is indicated by the coordinate data ($X_{507}$, $Y_{507}$) (Step S6). For the first stitch that is sewn after the sewing is restarted, the embroidery frame 34 has already been transferred by the processing at Step S166 that is shown in FIG. 10, such that the position of the needle drop point is at the position that is indicated by the coordinate data ($X_{507}$, $Y_{507}$). Therefore, the embroidery frame 34 is not actually transferred (Step S6). Next, the sewing of one stitch is performed (Step S7). The current counter value N is 507, which is not equal to the final counter value M of 1500 (NO at Step S8). An error has not occurred (NO at Step S9), so the counter value N is increased by one from 507 to 508 (Step S10). The CPU 71 then returns to Step S5 and repeatedly performs the processing. In other words, the sewing is continually performed.

In a case where the sewing is continually performed without the occurrence of an error (Steps S6 to S10), the counter value N that is stored in the counter value storage area 733 ultimately becomes 1500, the last value of the counter values N that are shown in FIG. 12 (Step S10). Then the embroidery frame 34 is transferred (Step S6) such that the position of the needle drop point is changed to the position that is indicated by the coordinate data ($X_{1500}$, $Y_{1500}$), and the sewing is performed (Step S7). The counter value N is 1500, which is equal to the final counter value M of 1500 (YES at Step S8). The CPU 71 returns to the processing at Step S2, and the counter value N that is stored in the counter value storage area 733 is set to zero (Step S2). In this manner, the embroidery sewing of the sample embroidery pattern 110 (refer to FIG. 11) is completed. Then the screen for the pattern selection processing is displayed (Step S3). The user may use the screen for the pattern selection processing to select another embroidery pattern, to shift to another mode (not shown in the drawings), and to terminate the use of the sewing machine 1 (not shown in the drawings).

As explained above, in the sewing machine 1 in the present embodiment, in a case where a thread break occurs, the operation keys such as the forward one stitch key 122, the back one stitch key 123, the third close key 124, and the like, as well as the image of the area that includes the needle drop point that has been captured by the image sensor 50, are automatically displayed on the liquid crystal display 15. This makes it possible for the user to change the needle drop point to the position where the thread break occurred while looking only at the liquid crystal display 15. Therefore, the user may smoothly perform adjustment of the needle drop point without having to check the needle drop point and the liquid crystal display 15 any number of times.

The sewing machine 1 according to the present embodiment is an example, and it is obvious that various types of modifications may be made to the sewing machine 1 according to the present embodiment. For example, in the present embodiment, in a case where one of the forward one stitch key 122 and the back one stitch key 123 is selected, the image that is captured by the image sensor 50 is updated. However, the image sensor 50 may capture a moving image, and the captured moving image may be constantly displayed on the liquid crystal display 15. An image may be captured after the sewing has been stopped due to a thread break error, and the captured image may be displayed on the liquid crystal display 15. The displayed image may not be updated in a case where one of the forward one stitch key 122 and the back one stitch key 123 is selected.

In the present embodiment, the forward one stitch key 122 and the back one stitch key 123 are used for adjusting the needle drop point. However, keys that are used to move the needle drop point forward by a plurality of stitches, such as a forward ten stitches key, a forward one hundred stitches key, and the like, as well as keys that are used to move the needle drop point back by a plurality of stitches, such as a back ten stitches key, a back one hundred stitches key, and the like, for example, may be displayed on the liquid crystal display 15 and may be used for adjusting the needle drop point. In the present embodiment, the operation keys such as the forward one stitch key 122, the back one stitch key 123, the third close key 124, and the like are displayed on the liquid crystal display 15, and the user may select any of the operation keys by a panel operation. However, the sewing machine 1 may be provided with button switches that correspond to the operation keys, which may be used for adjusting the needle drop point.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine that is capable of sewing an embroidery pattern on a work cloth held by an embroidery frame, the sewing machine comprising:

a display device configured to display at least one of an image and embroidery information;

a detection device configured to detect an occurrence of a thread break while sewing is in progress;

an image capture device configured to capture an image of at least an area including a needle drop point of a needle;

a display control device configured to display an image captured by the image capture device and an operation key on the display device when the detection device has detected the occurrence of the thread break, the operation key being configured to transfer the embroidery frame by at least one stitch; and a sewing control device configured to cause the embroidery frame to be transferred based on a number of stitches specified by operation of the operation key.

2. The sewing machine according to claim 1, wherein the image capture device captures the image of the area including the needle drop point every time the sewing control device causes the embroidery frame to be transferred by one stitch, and the display control device is configured to display the image captured by the image capture device and the operation key on the display device.

3. A computer-readable medium storing a control program executable on a sewing machine that is configured to sew an embroidery pattern on a work cloth held by an embroidery frame, the program comprising instructions that cause a computer to perform the steps of:

receiving a signal that is transmitted when a thread break has occurred while sewing is in progress;

displaying an image and an operation key on a display device when the signal is received, the image being captured by an image capture device configured to capture an image of at least an area including a needle drop point of a needle, the operation key being configured to transfer the embroidery frame by at least one stitch, and the display device being configured to display at least one of the image and embroidery information; and causing the embroidery frame to be transferred based on a number of stitches specified by operation of the operation key.

4. The computer-readable medium according to claim 3, wherein the image of the area including the needle drop point is captured every time the embroidery frame is transferred by one stitch, and the captured image and the operation key are displayed on the display device.

5. The sewing machine according to claim 1, wherein:

the display control device is a first display control device configured to display:

the image captured by the image capture device, the operation key, and a first mark on the display device, the first mark being a mark that indicates a present needle drop point in the image captured by the image capturing device when the detection device has detected the occurrence of the thread break; and further comprising:

a second display control device configured to display:

the image captured by the image capture device, the operation key, and a second mark on the display device, the second mark being a mark that indicates a needle drop point after the embroidery frame has been transferred by the sewing control device in the image captured by the image capture device when the sewing control device has transferred the embroidery frame by at least one stitch.

6. The computer-readable medium according to claim 3, wherein the step of displaying comprises:

displaying the image captured by the image capture device, the operation key and a first mark on the display device when the detection device has detected the occurrence of the thread break, the first mark being a mark that indicates a present needle drop point in the image captured by the image capture device; and displaying the image captured by the image capture device, the operation key and a second mark on the display device when the sewing control device has transferred the embroidery frame by at least one stitch, the second mark being a mark that indicates a needle drop point after the embroidery frame has been transferred by the sewing control device in the image captured by the image capture device.

* * * * *